US009590291B2

(12) United States Patent
Lee et al.

(10) Patent No.: US 9,590,291 B2
(45) Date of Patent: Mar. 7, 2017

(54) ANTENNA APPARATUS AND ELECTRONIC DEVICE HAVING THE SAME

(71) Applicant: Samsung Electronics Co., Ltd., Gyeonggi-do (KR)

(72) Inventors: Kyung-Jong Lee, Gyeonggi-do (KR); Se-Woong Kim, Gyeongsangnam-do (KR); Jung-Ho Park, Gyeonggi-do (KR); Kyung-Jae Lee, Seoul (KR); Soo-Young Jang, Daegu (KR); Austin Kim, Gyeonggi-do (KR); Seung-Hwan Kim, Seoul (KR); Joon-Ho Byun, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 14/831,355

(22) Filed: Aug. 20, 2015

(65) Prior Publication Data

US 2016/0056531 A1 Feb. 25, 2016

(30) Foreign Application Priority Data

Aug. 21, 2014 (KR) ..... 10-2014-0109086

(51) Int. Cl.

| | |
|---|---|
| ***H01Q 1/24*** | (2006.01) |
| ***H01Q 9/42*** | (2006.01) |
| ***H01Q 19/10*** | (2006.01) |
| ***H01Q 7/00*** | (2006.01) |
| ***H01Q 21/30*** | (2006.01) |

(52) U.S. Cl.

CPC ..... *H01Q 1/243* (2013.01); *H01Q 7/00* (2013.01); *H01Q 9/42* (2013.01); *H01Q 19/10* (2013.01); *H01Q 21/30* (2013.01)

(58) Field of Classification Search

CPC ..... H01Q 19/10; H01Q 1/243; H01Q 21/30; H01Q 7/00; H01Q 9/42

USPC ..... 343/700 MS, 702, 829, 846

See application file for complete search history.

(56) References Cited

U.S. PATENT DOCUMENTS 7,180,464 B2 * 2/2007 Chiang ..... H01Q 1/242 343/702

7,453,404 B2 * 11/2008 Ying ..... H01Q 1/22 343/700 MS (Continued)

FOREIGN PATENT DOCUMENTS

KR 10-2013-0020981 3/2013

OTHER PUBLICATIONS

International Search Report dated Dec. 4, 2015 issued in counterpart application No. PCT/KR2015/008675, 6 pages.

(Continued)

*Primary Examiner* — Tho G Phan

(74) *Attorney, Agent, or Firm* — The Farrell Law Firm, P.C.

(57) ABSTRACT

An antenna apparatus and an electronic device having the same is provided. The electronic device includes an antenna radiator formed in a loop shape having at least one opening end part opened by a slit, at least a portion of the at least one opening end part is fed, at least one electronic component of metal material electrically connected with the antenna radiator, and at least one metal member arranged around the antenna radiator, where the at least one opening end part is formed in a reverse direction from the direction of the metal member.

20 Claims, 21 Drawing Sheets

(56) References Cited

U.S. PATENT DOCUMENTS

| | | | | |
|---|---|---|---|---|
| 7,642,970 | B2 * | 1/2010 | Aoyama | H01Q 1/243 343/700 MS |
| 7,830,325 | B2 * | 11/2010 | Qi | H01Q 1/243 343/702 |
| 9,325,070 | B1 * | 4/2016 | Obeidat | H01Q 9/0407 |
| 2004/0108957 | A1 | 6/2004 | Umehara et al. | |
| 2007/0285321 | A1 * | 12/2007 | Chung | H01Q 1/38 343/702 |
| 2008/0258992 | A1 | 10/2008 | Tsai et al. | |
| 2010/0127948 | A1 | 5/2010 | Maruyama | |
| 2011/0037664 | A1 | 2/2011 | Cho et al. | |
| 2012/0262345 | A1 | 10/2012 | Kim et al. | |
| 2013/0050026 | A1 | 2/2013 | Vin et al. | |
| 2013/0057437 | A1 | 3/2013 | Chiu et al. | |
| 2013/0194139 | A1 | 8/2013 | Nickel et al. | |
| 2013/0214979 | A1 | 8/2013 | McMilin et al. | |
| 2014/0078008 | A1 | 3/2014 | Kang et al. | |
| 2015/0130670 | A1 | 5/2015 | Vin et al. | |

OTHER PUBLICATIONS

European Search Report dated Dec. 11, 2015 issued in counterpart application No. 15181768.1-1812, 7 pages.

* cited by examiner

ANTENNA APPARATUS AND ELECTRONIC DEVICE HAVING THE SAME

PRIORITY

This application claims priority under 35 U.S.C. §119(a) to a Korean Patent Application filed in the Korean Intellectual Property Office on Aug. 21, 2014, and assigned Serial No. 10-2014-0109086, the contents of which are incorporated herein by reference.

BACKGROUND OF THE INVENTION

1. Field of the Invention

The present disclosure relates to an electronic device, and more particularly to an electronic device having an antenna apparatus.

2. Description of the Related Art

The growth of electronic telecommunication technologies has led to the emergence of electronic devices having various functions. In general, these electronic devices are capable of performing multiple complex functions.

As the functional gap between the electronic devices of the various manufacturing companies has noticeably decreased, the manufacturing companies have begun to increasingly focus on improving the physical aspects of electronic devices. Over time, electronic devices, such as smartphones, have become more lightweight, thinner, and smaller. To satisfy the interests of consumers, manufacturers have focused on improving the rigidity of electronic devices as they become slimmer, and strengthening the design aspects of the electronic devices. As part of this trend, manufacturing companies replace some of the constituent physical elements of the electronic devices with metal materials to increase the rigidity of the electronic devices and, concurrently, improve the aesthetic appeal of the electronic devices. As a result, manufacturing companies are now struggling to solve grounding issues, antenna radiation performance deterioration issues, etc. arising from the use of such metal materials.

Accordingly, an antenna apparatus for an electronic device may have a basic structure of a Planar Inverted—F Antenna (PIFA) or monopole radiator. The volume and number of mounted antenna radiators may be determined according to a service frequency, bandwidth, and the type of antenna. The antenna apparatus may use a communication band of a low-frequency band of 700 Mega Hertz (MHz) to 900 MHz and a high-frequency band of 1700 MHz to 2100 MHz. For instance, the antenna apparatus has to satisfy various wireless communication services such as Long Term Evolution (LTE), Bluetooth (BT), Global Positioning System (GPS), and WiFi services. An electronic device of a defined size needs to satisfy all of the aforementioned communication bands in the volume of a given antenna radiator, needs to have an electric field equal to or less than a Specific Absorption Rate (SAR) reference value for determining health risks, and needs to overcome radiation performance interference caused by a metal member, such as a metal housing or a Universal Serial Bus (USB).

SUMMARY OF THE INVENTION

The present disclosure has been made to address at least the problems and disadvantages described above, and to provide at least the advantages described below.

Accordingly, an aspect of the present disclosure is to provide an antenna apparatus (e.g., a Metal Device Antenna (MDA)) using an existing metal member of the electronic device as a radiator for the antenna, a bezel-antenna apparatus using a metal housing of the electronic device as a radiator, etc.

Accordingly, another aspect of the present disclosure is to provide an antenna apparatus, and an electronic device having the same, implemented to prevent radiation performance deterioration caused by a metal member (e.g., a metal housing of an electronic device).

Accordingly, another aspect of the present disclosure is to provide an antenna apparatus, and an electronic device having the same, which is aesthetically pleasing, has sufficient rigidity, and concurrently contributes to radiation performance improvement.

In accordance with an aspect of the present disclosure, an electronic device is provided. The electronic device includes an antenna radiator formed in a loop shape having at least one opening end part opened by a slit, the slit feeding the at least one opening end part, at least one electronic component of metal material electrically connected with the antenna radiator, and at least one metal member arranged around the antenna radiator, where the at least one opening end part is formed in a reverse direction from the direction of the metal member.

In accordance with another aspect of the present disclosure, antenna apparatus is provided. The antenna apparatus includes an antenna radiator formed in a loop shape having at least one opening end part opened by a slit, the slit feeding the at least one opening end part, and at least one electronic component of metal material electrically connected with the antenna radiator, where the at least one opening end part is formed in a reverse direction from the direction of a peripheral metal member.

BRIEF DESCRIPTION OF THE DRAWINGS

The above and other aspects, features, and advantages of the present disclosure will become more apparent from the following detailed description taken in conjunction with the accompanying drawings in which.

DETAILED DESCRIPTION OF EMBODIMENTS OF THE PRESENT INVENTION

Figure 1:
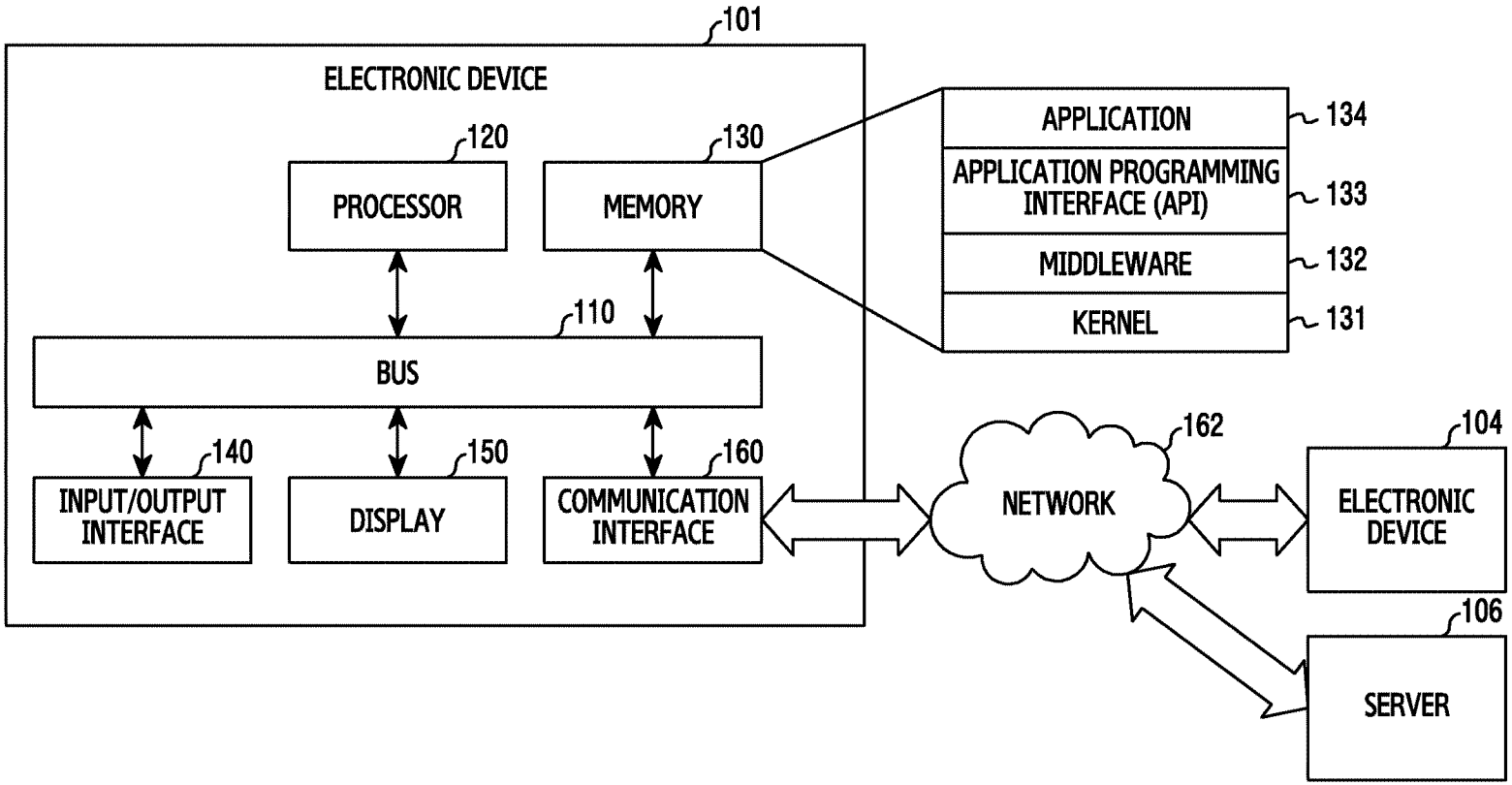
FIG. 1 is a diagram illustrating a network environment including an electronic device, according to an embodiment of the present disclosure.

Hereinafter, various embodiments of the present disclosure are described with reference to the accompanying drawings. While the various embodiments of the present disclosure are susceptible to various modifications and alternative forms, specific embodiments are shown by way of example in the drawings and will herein be described in detail. It should be understood, however, that is the various embodiments are not intended to limit the scope of the present disclosure to the particular form disclosed, but, on the contrary, the scope of the present disclosure covers all modifications, equivalents, and alternatives falling within the spirit and scope of the various embodiments of the present disclosure as defined by the appended claims. In describing the various embodiments, like reference numerals denote like constitutional elements throughout the drawings.

The terms "include" and "may include" used herein are intended to indicate the presence of a corresponding function, operation, or constitutional element disclosed herein, and are not intended to limit the presence of one or more functions, operations, or constitutional elements. In addition, the terms "include" and "have" are intended to indicate that characteristics, numbers, steps, operations, constitutional elements, and elements disclosed in the specification or combinations thereof exist; however, additional possibilities of one or more other characteristics, numbers, steps, operations, constitutional elements, elements or combinations thereof may exist.

As used herein, the expression "or" includes any and all combinations of words enumerated together. For example, "A or B" may include either A or B, or may include both A and B.

Although expressions used in various embodiments of the present disclosure such as "$1^{st}$", "$2^{nd}$", "first", "second" may be used to express various constituent elements of the various embodiments, these expressions are not intended to limit the corresponding constituent elements. For example, the above expressions are not intended to limit an order or an importance of the corresponding constituent elements. The above expressions may be used to distinguish one constituent element from another constituent element. For example, a first user device and the second user device are both user devices, and indicate different user devices. For example, a first constituent element may be referred to as a second constituent element, and similarly, the second constituent element may be referred to as the first constituent element without departing from the scope of the present disclosure.

When an element is mentioned as being "connected" to or "accessing" another element, this may mean that it is directly connected to or accessing the other element, or there may be intervening elements present between the two elements. On the other hand, when a element is mentioned as being "directly connected" to or "directly accessing" another element, it is to be understood that there are no intervening elements present.

By the term "substantially" it is meant that the recited characteristic, parameter, or value need not be achieved exactly, but that deviations or variations, including but not limited to, for example, tolerances, measurement errors, measurement accuracy limitations and other factors known to persons of ordinary skill in the art, may occur in amounts that do not preclude the effect the characteristic was intended to provide.

The terminology used herein is for the purpose of describing particular embodiments of the present disclosure only and is not intended to be limiting of the various embodiments of the present disclosure. A singular expression includes a plural expression unless there is a contextually distinctive difference between the expressions.

Unless otherwise defined, all terms, including technical and scientific terms, used herein have the same meaning as commonly understood by those of ordinary skill in the art to which various embodiments of the present disclosure belong. It will be further understood that terms, such as those defined in commonly used dictionaries, should be interpreted as having a meaning that is consistent with their meaning in the context of the relevant art and the various embodiments of the present disclosure, and should not be interpreted in an idealized or overly formal sense unless expressly so defined herein.

An electronic device according to various embodiments of the present disclosure may be a device including an antenna capable of performing a communication function in at least one frequency band. For example, the electronic device may be a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a MPEG-1 Audio Layer 3 (MP3) player, a mobile medical device, a camera, and a wearable device (e.g., a Head-Mounted-Device (HMD), such as electronic glasses, electronic clothes, an electronic bracelet, an electronic necklace, an electronic appcessory, an electronic tattoo, or a smart watch).

According to certain embodiments, the electronic device may be a smart home appliance having an antenna. For example, the smart home appliance may include at least one of a TeleVision (TV), a Digital Versatile Disk (DVD) player, an audio player, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain embodiments, the electronic device including the antenna may be one of various medical devices (e.g., Magnetic Resonance Angiography (MRA), Magnetic Resonance Imaging (MRI), Computed Tomography (CT), imaging equipment, ultrasonic instrument, etc.), a navigation device, a Global Positioning System (GPS) receiver, an Event Data Recorder (EDR), a Flight Data Recorder (FDR), a car infotainment device, electronic equipment for a ship (e.g., a vessel navigation device, a gyro compass, etc.), avionics, a security device, a car head unit, an industrial or domestic robot, an Automatic Teller Machine (ATM), and Point Of Sales (POS) device.

According to certain embodiments, the electronic device may be part of at least one of an item of furniture or a building/structure including an antenna. The electronic device may be an electronic board, an electronic signature input device, a projector, or any of various measurement machines (e.g., water supply, electricity, gas, propagation measurement machine, etc.).

The electronic device may be one or more combinations of the aforementioned various devices. In addition, the electronic device may be a flexible device. Moreover, the electronic device is not limited to the aforementioned devices.

Hereinafter, an electronic device according to various embodiments will be described with reference to the accompanying drawings. The term 'user' used in the various embodiments may refer to a person who uses the electronic device or a device which uses the electronic device (e.g., an Artificial Intelligence (AI) electronic device).

FIG. 1 is a diagram illustrating a network environment including an electronic device, according to an embodiment of the present disclosure.

Referring to FIG. 1, a network environment including an electronic device 101 is provided. Electronic device 101 includes a bus 110, a processor 120, a memory 130, an input/output interface 140, a display 150, and a communication interface 160.

The bus 110 is a circuit for connecting the aforementioned elements (e.g., the processor 120, the memory 130, the input/output interface 140, the display 150, and the communication interface 160) to each other and for delivering communication (e.g., a control message) between the aforementioned elements.

The processor 120 receives an instruction from the aforementioned different elements (e.g., the memory 130, the input/output interface 140, the display 150, the communication interface 160) via the bus 110, and thus may interpret the received instruction and execute arithmetic processing or data processing according to the interpreted instruction.

The memory 130 stores an instruction or data received from the processor 120 or different elements or generated by the processor 120 or the different elements. The memory 130 includes programming modules such as a kernel 131, a middleware 132, an Application Programming Interface (API) 133, and an application 134. Each of the aforementioned programming modules may consist of software, firmware, or hardware entities or may consist of at least two or more combinations thereof.

The kernel 131 controls or manages the system resources (e.g., the bus 110, the processor 120, the memory 130, etc.) used to execute an operation or function implemented in the middleware 132, the API 133, or the application 134. In addition, the kernel 131 provides a controllable or manageable interface by accessing individual constituent elements of the electronic device 101 in the middleware 132, the API 133, or the application 134.

The middleware 132 performs a mediation role so that the API 133 or the application 134 communicates with the kernel 131 to exchange data. In addition, regarding task requests received from the application 134, the middleware 132 performs a control (e.g., scheduling or load balancing) for the task requests by using a method of assigning a priority for using a system resource of the electronic device 101 to at least one of the application 134.

The API 133 includes at least one interface or function (e.g., instruction) for file control, window control, video processing, character control, etc., as an interface capable of controlling a function provided by the application 134 in the kernel 131 or the middleware 132.

The application 134 may include an Short Message Service (SMS)/Multimedia Messaging Service (MMS) application, an e-mail application, a calendar application, an alarm application, a health care application (e.g., an application for measuring a physical activity level, a blood sugar, etc.) or an environment information application (e.g., atmospheric pressure, humidity, or temperature information). Additionally or alternatively, the application 134 may be an application related to an information exchange between the electronic device 101 and an external electronic device 104 or server 106. The application related to the information exchange includes a notification relay application for relaying specific information to the external electronic device or a device management application for managing the external electronic device.

The notification relay application includes a function of relaying notification information generated in another application (e.g., an SMS/MMS application, an e-mail application, a health care application, an environment information application, etc.) of the electronic device 101 to the external electronic device 104 or server 106. Additionally or alternatively, the notification relay application receives notification information from the external electronic device 104, and provides the notification information to the user.

The device management application manages a function for at least one part of the external electronic device 104 which communicates with the electronic device 101. Examples of the function include turning on/turning off the external electronic device 104 itself (or some components thereof) or adjusting of a display illumination (or a resolution), and managing (e.g., installing, deleting, or updating) an application which operates in the external electronic device 104 or a service (e.g., a call service or a message service) provided by the external electronic device 104.

The application 134 includes an application specified according to attribute information (e.g., an electronic device type) of the external electronic device 104. For example, if the external electronic device 104 is an MP3 player, the application 134 may include an application related to a music play. Similarly, if the external electronic device 104 is a mobile medical device, the application 134 may include an application related to a health care. The application 134 may include at least one of a specified application in the electronic device 101 or an application received from the external electronic device 104.

The input/output interface 140 relays an instruction or data input from a user by using a sensor (e.g., an acceleration sensor, a gyro sensor) or an input device (e.g., a keyboard or a touch screen) to the processor 120, the memory 130, or the communication interface 160, for example, via the bus 110. For example, the input/output interface 140 provides data regarding a user's touch input via the touch screen to the processor 120. In addition, the input/output interface 140 outputs an instruction or data received from the processor 120, the memory 130, or the communication interface 160 to an output device (e.g., a speaker or a display), for example, via the bus 110. For example, the input/output interface 140 outputs audio data provided by using the processor 120 to the user via the speaker.

The display 150 displays a variety of information (e.g., multimedia data or text data) to the user.

The communication interface 160 connects a communication between the electronic device 101 and the electronic device 104 or the server 106. The communication interface 160 includes an antenna 230, examples of which are described hereinafter. The communication interface 160 may communicate with the external electronic device 104 and the server 106 by being connected with a network 162 through wireless communication or wired communication.

The wireless communication includes, for example, at least one of Wi-Fi, Bluetooth (BT), Near Field Communication (NFC), Global Positioning System (GPS), and cellular communication (e.g., LTE, LTE-A, CDMA, WCDMA, UMTS, WiBro, GSM, etc.).

The wired communication includes, for example, at least one of Universal Serial Bus (USB), High Definition Multimedia Interface (HDMI), Recommended Standard (RS)-232, and Plain Old Telephone Service (POTS).

The network 162 may be a telecommunications network. The telecommunications network includes at least one of a computer network, an Internet, an Internet of Things, and a telephone network. A protocol (e.g., a transport layer protocol, a data link layer protocol, or a physical layer protocol) for communication between the electronic device 101 and an external electronic device 104 may be supported in at least one of the application 134, the application programming interface 133, the middleware 132, the kernel 131, and the communication interface 160.

Figure 2:
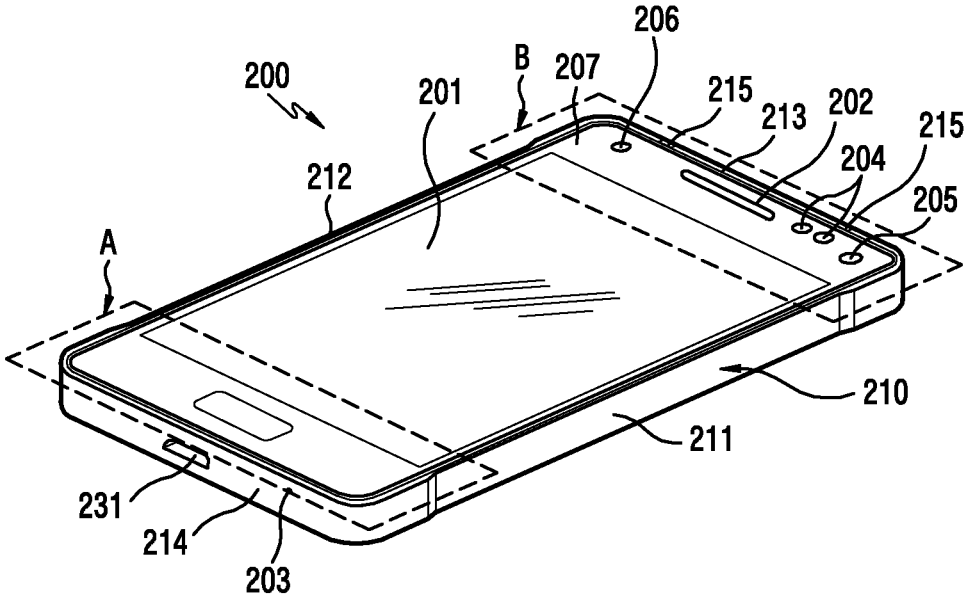
FIG. 2 is a perspective diagram illustrating an electronic device applying a metal housing, according to an embodiment of the present disclosure.

FIG. 2 is a perspective diagram illustrating an electronic device applying a metal housing, according to an embodiment of the present disclosure.

Referring to FIG. 2, a display 201 is installed in a front surface 207 of the electronic device 200. A speaker device 202 is installed at an upper side of the display 201, to output a voice of a counterpart. A microphone device 203 is installed at a lower side of the display 201, and transmits a voice input to the electronic device to the counterpart.

According to one exemplary embodiment, components for performing various functions of an electronic device 200 are arranged around the speaker device 202. The components include at least one sensor module 204, a camera device 205, and a Light Emitting Diode (LED) indicator 206.

This sensor module 204 may, for instance, include at least one of an illumination sensor (e.g., an optical sensor), a proximity sensor (e.g., an optical sensor), an infrared sensor, and an ultrasonic sensor.

The LED indicator 206 enables a user to recognize status information of the electronic device 200.

The electronic device 200 includes a metal bezel 210 as a metal housing. The metal bezel 210 is arranged along an edge of the electronic device 200, and may be arranged to extend from the edge to at least a partial region of a rear surface of the electronic device 200. The metal bezel 210 defines a thickness of the electronic device 200 along the edge of the electronic device 200, and is formed to have a closed loop shape. The metal bezel 210 is not limited to this construction, and may be also formed in a manner of contributing to at least a part of the thickness of the electronic device 200. The metal bezel 210 may be also arranged only in at least a partial region along the edge of the electronic device 200. When the metal bezel 210 contributes as a part of a housing of the electronic device 200, the remnant part of the housing may be replaced with a non-metallic member. In this case, the metal bezel 210 may be formed in a manner of insert injecting the non-metallic member. The metal bezel 210 includes at least one segment part 215. Thus, unit bezel parts segmented by the segment part 215 may be exploited as antenna radiators as well.

When viewing a front of the electronic device 200, the metal bezel 210 is formed to include the right bezel part 211, the left bezel part 212, the upper bezel part 213, and the lower bezel part 214.

The antenna apparatus may be arranged in an 'A' region or a 'B' region of the electronic device 200 being least affected when a user holds the electronic device 200 with a hand. However, the arrangement of the antenna apparatus is not limited these regions, and the antenna apparatus may be also arranged in a lengthwise direction in at least one of both lateral surfaces of the electronic device 200, in addition to the 'A' region or the 'B' region.

The antenna apparatus may use a metal member of the electronic device 200 as a part of a radiator of the antenna apparatus. The antenna apparatus includes an interface connector port (e.g., a micro USB port) of metal material. An antenna apparatus including the metal member is hereinafter referred to as a Metal Device Antenna (MDA). An antenna apparatus constructed in accordance with various embodiments of the present disclosure, whose radiation direction is a reverse direction to that of the MDA, is hereinafter referred to as a Metal Device Antenna-Reverse (MDA-R).

According to various embodiments of the present disclosure, the antenna apparatus is implemented as the MDA-R, and is designed to radiate in a reverse direction to that of a peripheral metal member (e.g., a metal housing). Accordingly, the antenna apparatus prevents radiation performance deterioration caused by an interference of the metal member.

Figure 3:
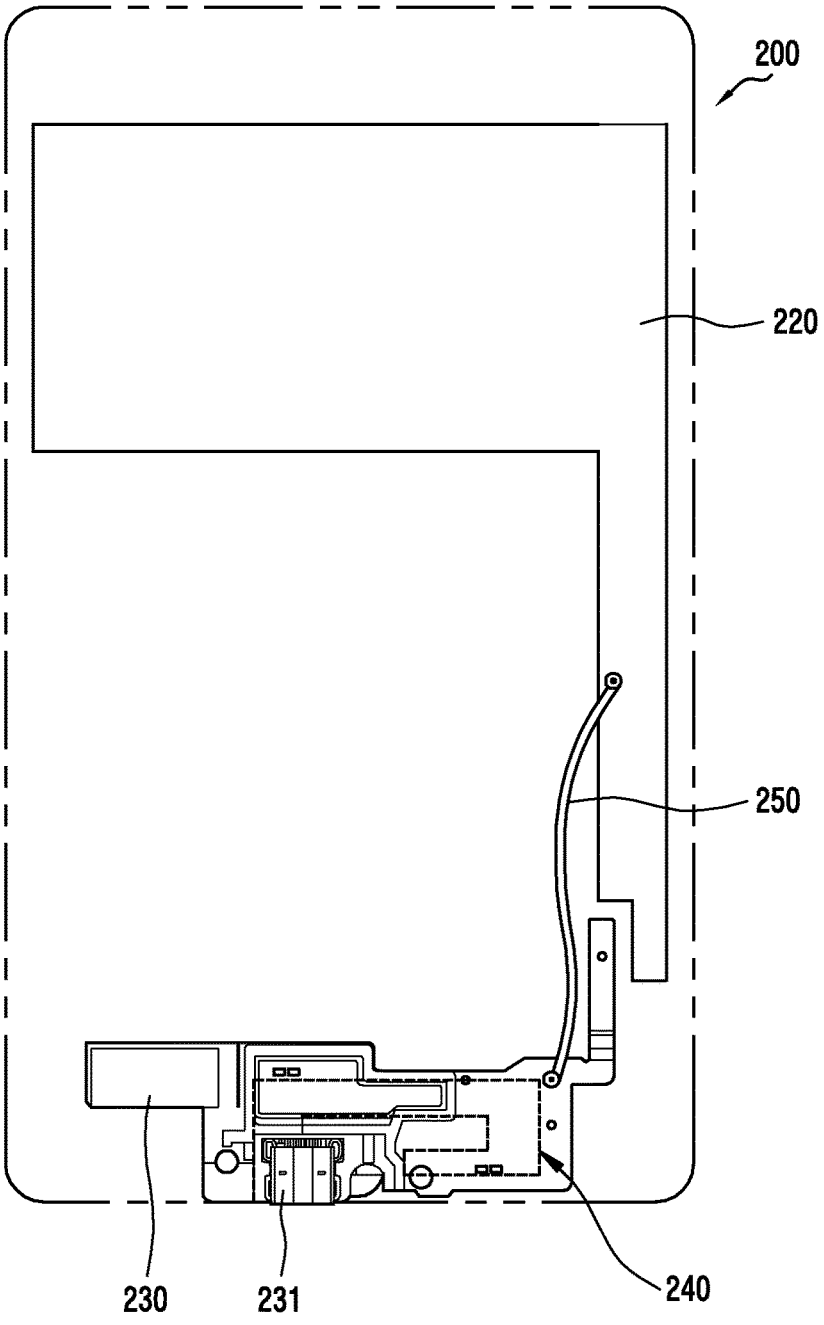
FIG. 3 is a diagram illustrating an arrangement of an antenna apparatus in an electronic device, according to an embodiment of the present disclosure.

FIG. 3 is a diagram illustrating an arrangement of an antenna apparatus in an electronic device, according to an embodiment of the present disclosure.

Referring to FIG. 3, the electronic device 200 includes a main Printed Circuit Board (PCB) 220 and a sub PCB 230. At least one antenna radiator 240 having a constant shape may be formed in the sub PCB 230 (i.e., a Printed circuit board Embedded Antenna (PEA)) or may be attached to the sub PCB 230. However, the antenna arrangement is not limited to this, and the antenna radiator 240 may be arranged on the main PCB 220 as well. The antenna radiator 240 may be arranged on all of the main PCB 220 and the sub PCB 230 as well. The antenna radiator 240 may be formed on the sub PCB 230 in a pattern scheme as well. The antenna radiator 240 may be a plate type metal or Flexible Printed Circuit (FPC) attached to the sub PCB 230 as well.

When the antenna radiator 240 is arranged on the sub PCB 230, a connector cable 250 may be also installed to electrically connect the antenna radiator 240 of the sub PCB 230 with a Radio Frequency (RF) connector arranged in a non-conductive region of the main PCB 220.

The sub PCB 230 mounts an interface connector port 231 (e.g., a USB connector port) of metal material in a Surface Mount Technology (SMT) scheme. The antenna apparatus may be constructed as the MDA, including the interface connector port 231. In place of the interface connector port 231, at least one of various electronic components of metal materials applied to the electronic device 200 may be contributed as an antenna radiator. The electronic component may include at least one of a speaker, a microphone, an ear jack assembly, and a vibrator.

If metal material is used as a housing of electronic device 200, an antenna apparatus using a PIFA or monopole antenna radiator may suffer from a phenomenon of radiation efficiency deterioration and interference although a sufficient antenna volume is secured. Also, the same problem occurs even when metal members, such as a USB connector port, a speaker, a microphone, an ear jack assembly, a vibrator, etc., are arranged adjacent to the antenna apparatus. If a high voltage is induced in an opening end region of the antenna radiator, the antenna radiator has an electric field as a main element of a short-range field. The electric field of the antenna radiator easily gives rise to the effect of coupling with a metal object adjacent to the antenna radiator. The coupling may excite an electric current of which direction causes radiation performance interference.

An MDA structure, which is a structure using these metal components (e.g., a USB, a microphone, a touch key, etc.) as the antenna radiator, may offer excellent performance compared to the conventional PIFA/monopole antenna apparatus. However, if a slit formed by an opening end of the antenna radiator is clogged with a peripheral metal member, the coupling phenomenon may occur at the opening end, being a main radiation region of the antenna radiator, degrading radiation performance.

According to various embodiments, to address this problem, the opening end, being the main radiation region of the antenna radiator, is designed to direct in a reverse direction of that of the MDA structure. Accordingly, although the metal member is arranged around the antenna radiator, because the main radiation region of the antenna radiator is designed to be spaced apart from the metal member, it minimizes performance deterioration caused by a phenomenon of coupling with the metal member. The peripheral metal member (e.g., metal housing) is designed to serve as a Ground (GND) connection part of an MDA-R structure, thereby minimizing a hand effect caused by metal.

Figure 4:
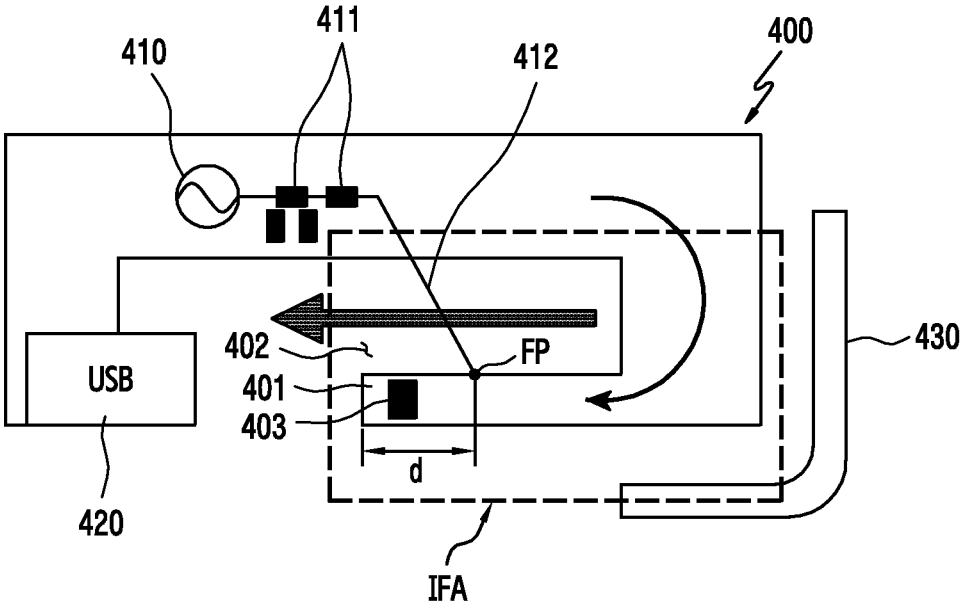
FIG. 4 is a schematic diagram illustrating an antenna apparatus, according to an embodiment of the present disclosure.

FIG. 4 is a schematic diagram illustrating an antenna apparatus, according to an embodiment of the present disclosure.

Referring to FIG. 4, an antenna radiator 400 is formed in a loop shape with a lower side opened. The antenna radiator 400 has a slit 402 provided in the center of the antenna radiator 400, and is closed in the direction of a metal bezel 430 (i.e., metal housing). The antenna radiator 400 includes an interface connector port 420 of metal material. The interface connector port 420 may serve as an antenna radiator as well.

The antenna radiator 400 includes an opened portion and an opening end 401 formed by the slit 402. The opening end 401 is formed to direct radiation in the direction of the interface connector port 420. The opening end 401 is formed to direct radiation in a reverse direction from the direction of the metal bezel 430. Accordingly, the antenna radiator 400 induces resonance at an opening end 402 portion, and guides the radiation direction in a reverse direction from the direction of the metal bezel 430 to exhibit efficient radiation performance.

The antenna radiator 400 is configured such that a predetermined feeding line 412 starting from a feeding part 410 of an RF signal input/output port may crosses the slit 402 and electrically connects to the neighborhood of the opening end 401. Accordingly, the antenna radiator 400 may have an electric length (d) ranging from one end of the opening end 401 to a Feeding Point (FP) of the opening end 401. Accordingly, the antenna radiator 400 may operate as an Inverted-F Antenna (IFA). A position of the Feeding Point (FP) of the opening end 401 is variously set to control the electrical length (d) of the antenna radiator 400. A matching element 411 may be interposed in the feeding line 412 to control an operation frequency band as well. A contact pad 403 is formed in at least a partial region of the opening end 401 and is electrically connected with the antenna radiator 400. The contact pad 403 may be connected with an additional antenna radiator to be described later. In this case, the additional antenna radiator may be electrically connected with the antenna radiator 400 by means of an electrical connection means (e.g., a C-clip, etc.) installed in the contact pad 403.

Figure 5:
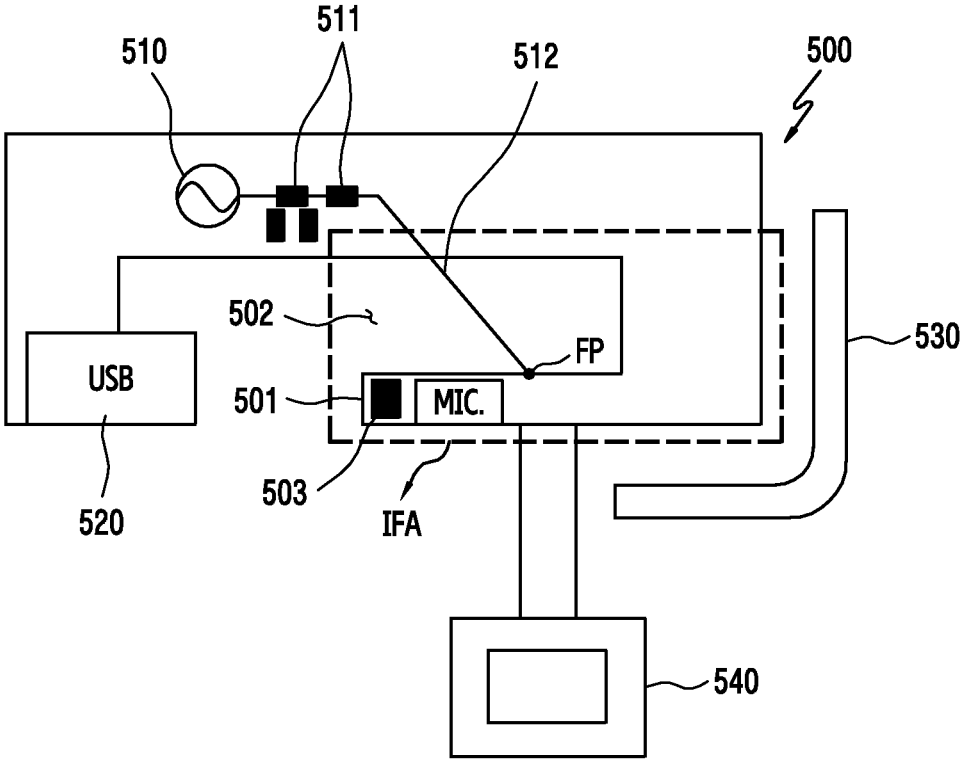
FIG. 5 is a schematic diagram illustrating an antenna apparatus using a touch key as a radiator, according to an embodiment of the present disclosure.

FIG. 5 is a schematic diagram illustrating an antenna apparatus using a touch key as a radiator, according to an embodiment of the present disclosure.

Referring to FIG. 5, an antenna radiator 500 is formed in a loop shape with a lower side opened. The antenna radiator 500 has a slit 502 provided in the center of the antenna radiator 500, and is closed in the direction of a metal bezel 530. The antenna radiator 500 includes an interface connector port 520 of metal material. The interface connector port 520 may serve as an antenna radiator as well.

The antenna radiator 500 includes an opened portion and an opening end 501 formed by the slit 502. The opening end 501 is formed to direct radiation in the direction of the interface connector port 520. The opening end 501 is formed to direct the radiation in a reverse direction from the direction of the metal bezel 530. Accordingly, the antenna radiator 500 induces resonance at an opening end 502 portion, and guides the radiation direction in a reverse direction from the direction of the metal bezel 530 to exhibit efficient radiation performance.

The antenna radiator 500 is configured such that a predetermined feeding line 512 starting from a feeding part 510 of an RF signal input/output port crosses the slit 502 and electrically connects to the neighborhood of the opening end 501. Accordingly, the antenna radiator 500 may be an IFA. A matching element 511 may be interposed in the feeding line 512 to control an operation frequency band as well. A contact pad 503 is formed in at least a partial region of the opening end 501 and be electrically connected with the antenna radiator 500. The contact pad 503 may be connected with an additional antenna radiator to be described later. In this case, the additional antenna radiator may be electrically connected with the antenna radiator 500 by means of an electrical connection means (e.g., a C-clip, etc.) installed in the contact pad 503.

The antenna radiator 500 is electrically connected with a touch key 540 that is used as a key input element of an electronic device 200. The touch key 540 may use a Flexible Printed Circuit (FPC), and an internal conductor pattern thereof may contribute as an additional antenna radiator. The touch key 540 may be used as the additional antenna radiator to connect with the ground, or may electrically connect a bead or inductance (L) element to a touch key signal line to control a resonant length of the antenna radiator 500.

Figure 6A:
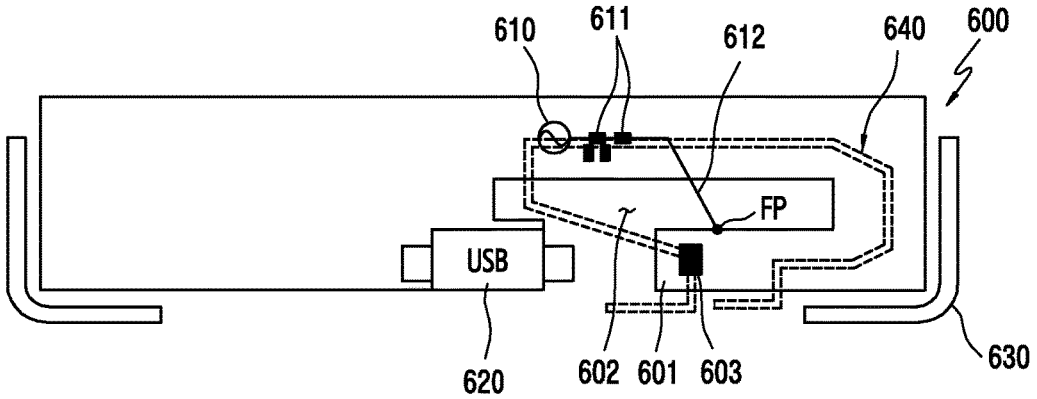
FIGS. 6A and 6B are schematic diagrams illustrating antenna apparatuses applying second radiators, according to an embodiment of the present disclosure.
Figure 6B:
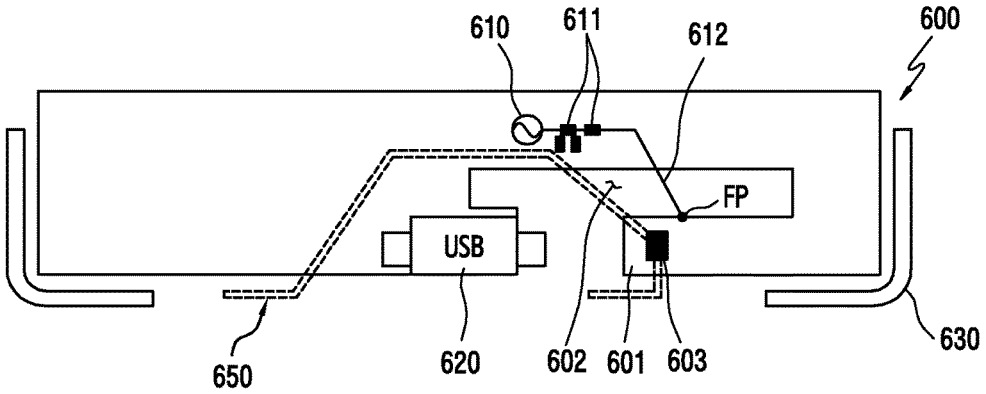

FIGS. 6A and 6B are schematic diagrams illustrating antenna apparatuses applying second radiators, according to an embodiment of the present disclosure.

Referring to FIGS. 6A and 6B, an antenna radiator 600 is formed in a loop shape with a lower side opened. The antenna radiator 600 has a slit 602 provided in the center of the antenna radiator 600, and is closed in the direction of a metal bezel 630. The antenna radiator 600 includes an interface connector port 620 of metal material. The interface connector port 620 may contribute as an antenna radiator as well.

The antenna radiator 600 includes an opened portion and an opening end 601 formed by the slit 602. The opening end 601 is formed to direct radiation in the direction of the interface connector port 620. The opening end 601 is formed to direct radiation in a reverse direction from the direction of the metal bezel 630. Accordingly, the antenna radiator 600 induces resonance at an opening end 602 portion, and guides the radiation direction in a reverse direction from the direction of the metal bezel 630 to exhibit efficient radiation performance.

The antenna radiator 600 is configured such that a predetermined feeding line 612 starting from a feeding part 610 of an RF signal input/output port crosses the slit 602 and electrically connects to the neighborhood of the opening end 601. Accordingly, the antenna radiator 600 may be an IFA. A matching element 611 may be interposed in the feeding line 612 to control an operation frequency band as well.

A contact pad 603 is formed in at least a partial region of the opening end 601 and is electrically connected with the antenna radiator 600. The contact pad 603 is connected with an additional antenna radiator 640 or 650. The additional antenna radiator 640 or 650 is electrically connected with the antenna radiator 600 by means of an electrical connection means (e.g., a C-clip, etc.) installed in the contact pad 603. A multi-band antenna apparatus operating in at least two frequency bands by the additional antenna radiator 640 or 650 may be implemented.

The additional antenna radiator 640 or 650 may be an antenna radiator arranged on an antenna carrier of dielectric material. In this case, the antenna carrier, including the additional antenna radiator 640 or 650, may be installed in a manner of being laminated on an upper part of the sub PCB 230 on which the antenna radiator 600 is formed. By mounting the antenna carrier on the sub PCB 230, the additional antenna radiator 640 or 650 comes in physical contact with the C clip installed in the contact pad 603 and electrically connects to the C clip. In this case, a pattern length of the additional antenna radiator 640 or 650 on the antenna carrier may be controlled to form multi-resonance.

As shown in FIGS. 6A and 6B, the additional antenna radiator 640 or 650 is in a state of being separated vertically from the antenna radiator 600 by the antenna carrier, but may be arranged in a position overlapped with the antenna radiator 600. The additional antenna radiator 640 or 650 may also maintain the state of being separated vertically from the antenna radiator 600 by self-structure, without being arranged on the antenna carrier. The additional antenna radiator 640 or 650 may be also arranged on the main PCB 220, without being arranged on the antenna carrier. In this case, the additional antenna radiator 640 or 650 may also maintain a state of being spaced apart from the antenna radiator 600 in a horizontal direction, i.e., not being spaced apart from the antenna radiator 600 in a vertical direction. The antenna radiator 600 may operate in a high-frequency band (e.g., 1700 MHz to 2100 MHz), and the additional antenna radiator 640 or 650 may operate in a low-frequency band (e.g., e.g., 700 MHz to 900 MHz).

Figure 7A:
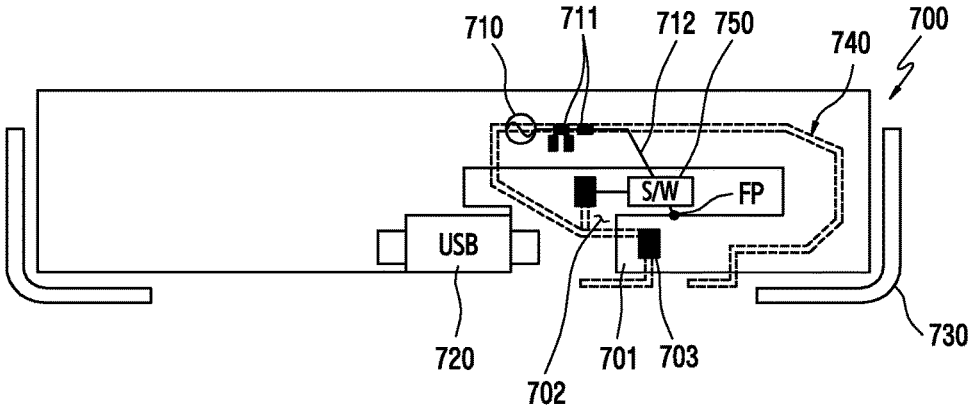
FIGS. 7A to 7C are schematic diagrams illustrating antenna apparatuses using switches, according to an embodiment of the present disclosure.
Figure 7B:
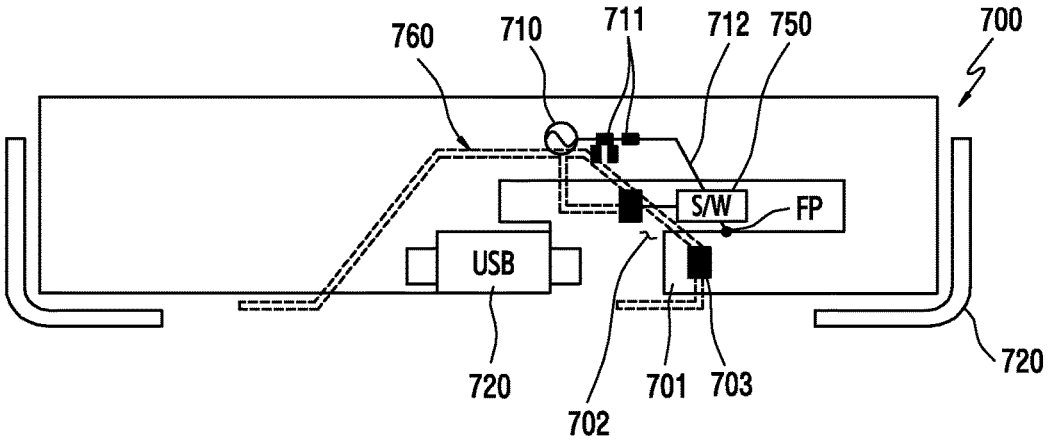
Figure 7C:
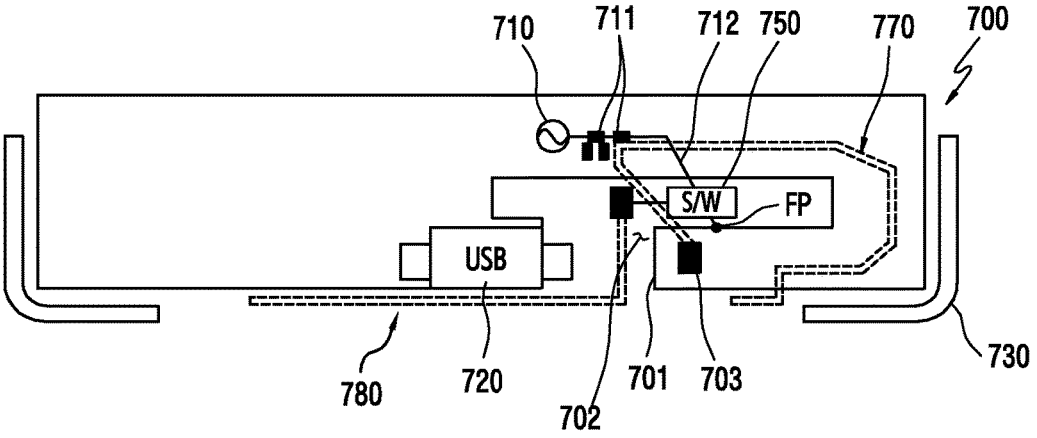

FIGS. 7A to 7C are schematic diagrams illustrating antenna apparatuses using switches according to various embodiments of the present disclosure.

Referring to FIGS. 7A to 7C, an antenna radiator 700 is formed in a loop shape with a lower side opened. The antenna radiator 700 has a slit 702 provided in the center of the antenna radiator 700, and is closed in the direction of a metal bezel 730. The antenna radiator 700 includes an interface connector port 720 of metal material. The interface connector port 720 may contribute as an antenna radiator as well.

The antenna radiator 700 includes an opened portion and an opening end 701 formed by the slit 702. The opening end 701 is formed to direct radiation in the direction of the interface connector port 720. The opening end 701 is formed to direct radiation in a reverse direction from the direction of the metal bezel 730. Accordingly, the antenna radiator 700 induces resonance at an opening end 702 portion, and guides the radiation direction in a reverse direction from the direction of the metal bezel 730 to exhibit efficient radiation performance.

The antenna radiator 700 is configured such that a predetermined feeding line 712 starting from a feeding part 710 of an RF signal input/output port crosses the slit 702 and electrically connects to the neighborhood of the opening end 701. Accordingly, the antenna radiator 700 may be an IFA. A matching element 711 may be interposed in the feeding line 712 to control an operation frequency band as well.

A contact pad 703 is formed in at least a partial region of the opening end 701 and is electrically connected with the antenna radiator 700. The contact pad 703 is connected with an additional antenna radiator 740, 760, or 770. The additional antenna radiator 740, 760, or 770 may be electrically connected with the antenna radiator 700 by means of an electrical connection means (e.g., a C-clip, etc.) installed in the contact pad 703. A multi-band antenna apparatus operating in at least two frequency bands by the additional antenna radiator 740, 760, or 770 may be implemented.

The additional antenna radiator 740, 760, or 770 may be an antenna radiator arranged on an antenna carrier of dielectric material. In this case, the antenna carrier including the additional antenna radiator 740, 760, or 770 may be installed in a manner of being laminated on an upper part of the sub PCB 230 on which the antenna radiator 700 is formed. By mounting the antenna carrier on the sub PCB 230, the additional antenna radiator 740, 760, or 770 comes in physical contact with the C clip installed in the contact pad 703 and electrically connects to the C clip. In this case, a pattern length of the additional antenna radiator 740, 760, or 770 on the antenna carrier may be controlled to form multi-resonance.

A switch 750 is interposed in the feeding line 712. One end of the switch 750 is electrically connected with the additional antenna radiator 740, 760, or 770. The switch 750 may operate the antenna radiator 700 and the additional antenna radiator 740, 760, or 770 or may selectively operate only the additional antenna radiator 740, 760, or 770 according to a switching operation, thereby switching an operation frequency band. The switch 750 may use Single Pole Single Throw (SPST), Single Pole Double Throw (SPDT), Single Pole Four Throw (SP4T), etc. By this switching operation of the switch 750, for instance, an operation frequency band of 791 MHz to 862 MHz may be switched to an operation frequency band of 880 MHz to 960 MHz. Additionally, for instance, an operation frequency band of 704 MHz to 746 MHz may be switched to an operation frequency band of 824 MHz to 894 MHz as well.

The antenna apparatus may also add one additional antenna radiator 740 or 760 to switch an operation frequency band as in FIGS. 7A and 7B, and add another additional antenna radiator 770 to switch an operation frequency band as in FIG. 7C.

Figure 8A:
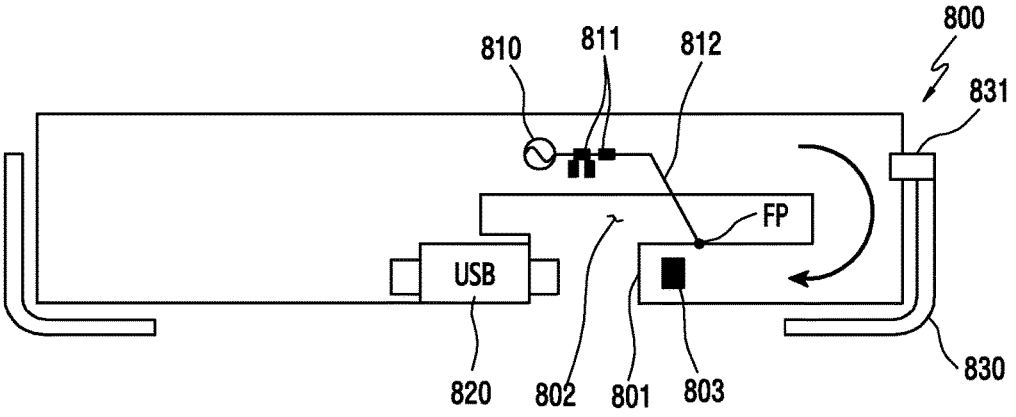
FIGS. 8A and 8B are schematic diagrams illustrating antenna apparatuses electrically connected with peripheral metal members according to an embodiment of the present disclosure.
Figure 8B:
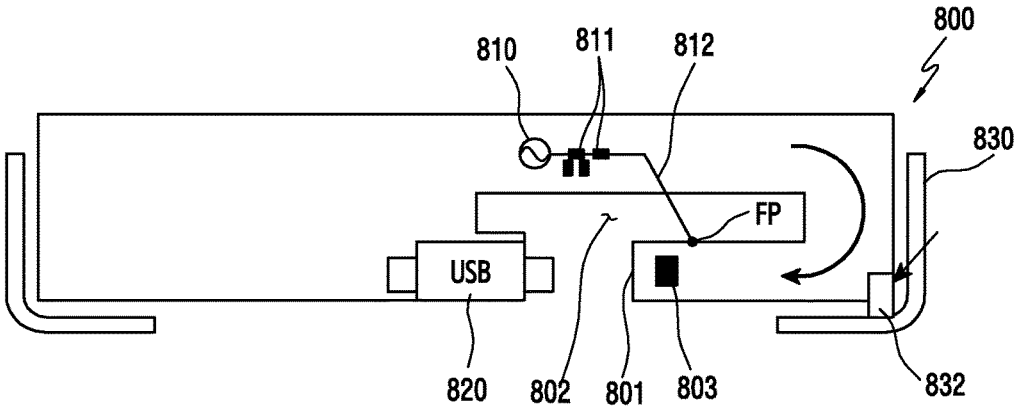

FIGS. 8A and 8B are schematic diagrams illustrating antenna apparatuses electrically connected with peripheral metal members, according to an embodiment of the present disclosure.

Referring to FIGS. 8A and 8B, an antenna radiator 800 is formed in a loop shape with a lower side opened. The antenna radiator 800 has a slit 802 provided in the center of the antenna radiator 800, and is closed in the direction of a metal bezel 830. The antenna radiator 800 includes an interface connector port 820 of metal material. The interface connector port 820 may contribute as an antenna radiator as well.

The antenna radiator 800 includes an opened portion and an opening end 801 formed by the slit 802. The opening end 801 is formed to direct radiation in the direction of the interface connector port 820. The opening end 801 is formed to direct radiation in a reverse direction from the direction of the metal bezel 830. Accordingly, the antenna radiator 800 induces resonance at an opening end 802 portion, and guides the radiation direction in a reverse direction from the direction of the metal bezel 830 to exhibit efficient radiation performance.

The antenna radiator 800 is configured such that a predetermined feeding line 812 starting from a feeding part 810 of an RF signal input/output port crosses the slit 802 and electrically connects to the neighborhood of the opening end 801. Accordingly, the antenna radiator 800 may be an IFA. A matching element 811 may be interposed in the feeding line 812 to control an operation frequency band as well. A contact pad 803 is formed in at least a partial region of the opening end 801 and is electrically connected with the antenna radiator 800. The contact pad 803 may be connected with an additional antenna radiator. In this case, the additional antenna radiator is electrically connected with the antenna radiator 800 by means of an electrical connection means (e.g., a C-clip, etc.) installed in the contact pad 803.

Although the opening end 801 of the antenna radiator 800 is formed to direct radiation in a reverse direction from the metal bezel 830, smooth radiation implementation may be interfered with by the peripheral metal bezel 830. To address this problem, the antenna radiator 800 may be ground connected with the metal bezel 830. Accordingly, the metal bezel 830 around the antenna radiator 800 no longer acts as a radiation interference object.

As illustrated in FIGS. 8A and 8B, the antenna radiator 800 is physically and electrically connected to the metal bezel 830 by means of an electrical connection member 831 or 832. At least one electrical connection member 831 or 832 is physically connected to at least one region among various positions of the metal bezel 830, thereby promoting additional performance improvement of the antenna radiator 800 in accordance with a position of a contact point between the electrical connection member 831 or 832 and the metal bezel 830.

Figure 9A:
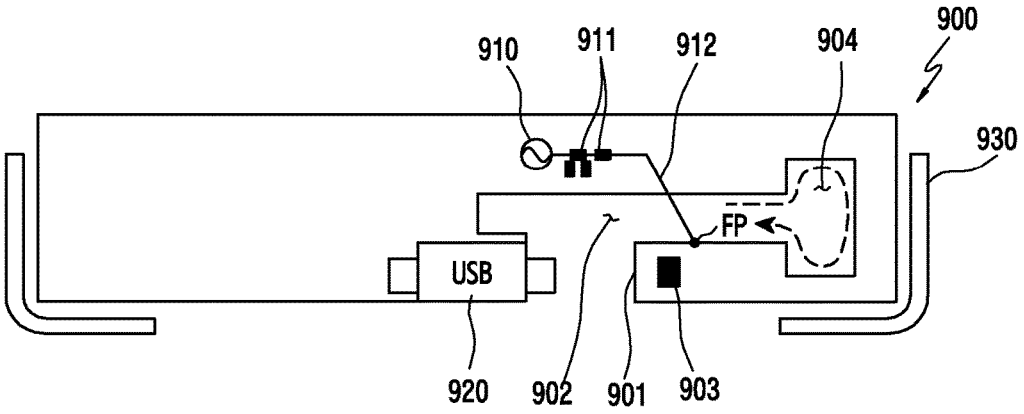
FIGS. 9A to 9C are schematic diagrams illustrating antenna apparatuses having multiple independent resonance forming structures, according to an embodiment of the present disclosure.
Figure 9B:
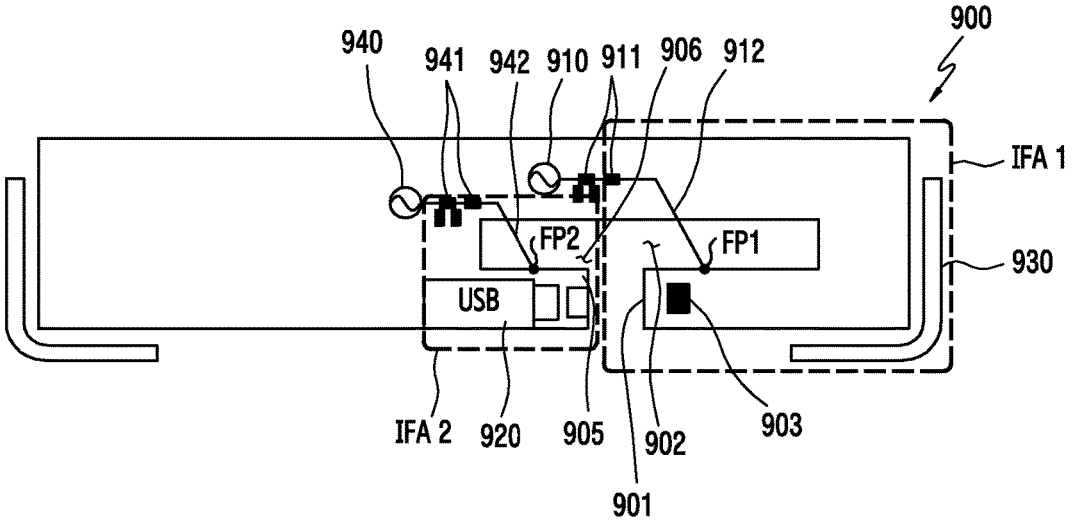
Figure 9C:
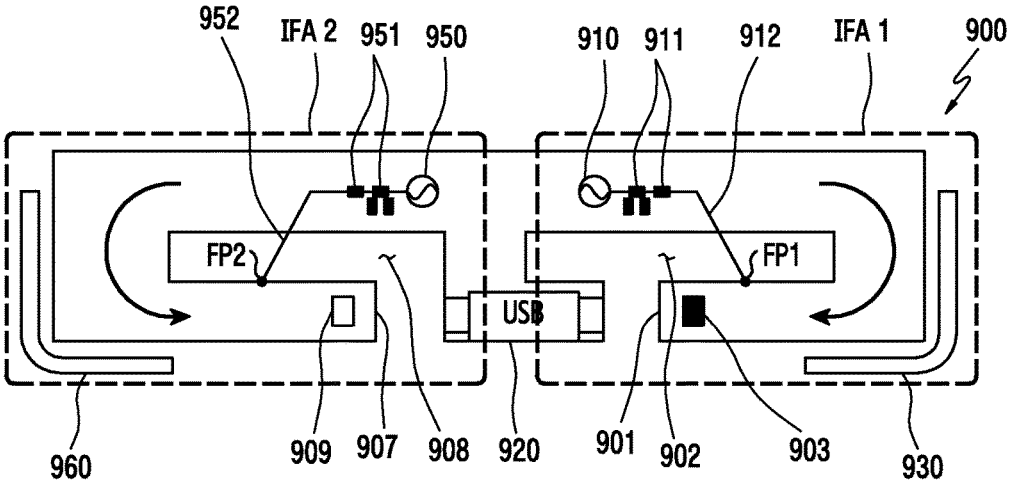

FIGS. 9A to 9C are schematic diagrams illustrating antenna apparatuses having multiple independent resonance forming structures, according to an embodiment of the present disclosure.

Referring to FIGS. 9A to 9C, an antenna radiator 900 is formed in a loop shape with a lower side opened. The antenna radiator 900 has a slit 902 provided in the center of the antenna radiator 900, and is closed in the direction of a metal bezel 930. The antenna radiator 900 includes an interface connector port 920 of metal material. The interface connector port 920 may contribute as an antenna radiator as well.

The antenna radiator 900 includes an opened portion and an opening end 901 formed by the slit 902. According to one embodiment, the opening end 901 is formed to direct radiation in the direction of the interface connector port 920. The opening end 901 is formed to direct radiation in a reverse direction from the direction of the metal bezel 930. Accordingly, the antenna radiator 900 induces resonance at an opening end 902 portion, and guides the radiation direction in a reverse direction from the direction of the metal bezel 930 to exhibit efficient radiation performance.

The antenna radiator 900 is configured such that a predetermined feeding line 912 starting from a feeding part 910 of an RF signal input/output port crosses the slit 902 and electrically connects to the neighborhood of the opening end 901. Accordingly, the antenna radiator 900 may be an IFA. A matching element 911 may be interposed in the feeding line 912 to control an operation frequency band as well. A contact pad 903 is formed in at least a partial region of the opening end 901 and is electrically connected with the antenna radiator 900. The contact pad 903 may be connected with an additional antenna radiator. In this case, the additional antenna radiator is electrically connected with the antenna radiator 900 by means of an electrical connection means (e.g., a C-clip, etc.) installed in the contact pad 903.

As illustrated in FIG. 9A, by expanding a non-ground region 904 within the slit 902, the antenna radiator 900 controls antenna impedance, and have an effect of improving a low-frequency bandwidth.

As illustrated in FIG. 9B, an antenna radiator structure (IFA1) using an existing antenna radiator and the same additional antenna radiator structure (IFA2) may be formed to face each other. In this case, even the same additional antenna radiator structure (IFA2) feeds a feeding point (FP2) from a feeding part 940 through a feeding line 942 as well. Also, the additional antenna radiator structure (IFA2) includes a matching element 941, and may implement a radiation end 905. Accordingly, by adding the independent feeding line 942, the antenna radiator 900 performs a radiation operation in the direction in which the antenna radiator structure (IFA1) and the additional antenna radiator structure (IFA2) face each other, through the two feeding lines 912 and 942 (901, 905→912, 942).

As illustrated in FIG. 9C, an antenna radiator structure (IFA1) using an existing antenna radiator and the same additional antenna radiator structure (IFA2) may be formed to face each other. The antenna radiator 900 may be formed such that one pair of the antenna radiator structures (IFA1 and IFA2) are symmetrical to each other with the interface connector port 920 interposed between the radiator structures. In this case, even the additional antenna radiator structure (IFA2) may feed a feeding point (FP2) from a feeding part 950 through a feeding line 952 as well. Also, the additional antenna radiator structure (IFA2) includes a matching element 951, and may implement a radiation end 907. Accordingly, by adding the independent feeding line 907, the antenna radiator 900 performs a radiation operation in the direction in which the antenna radiator structure (IFA1) and the additional antenna radiator structure (IFA2) face each other, through the two feeding lines 912 and 952 (901, 905→912, 952).

Figure 10:
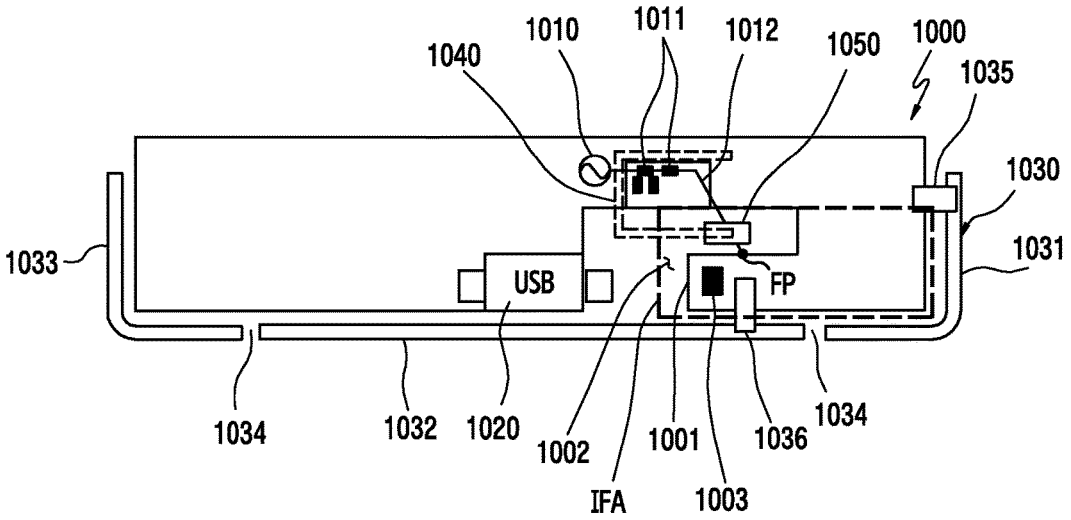
FIG. 10 is a schematic diagram illustrating an antenna apparatus applying a metal housing, according to an embodiment of the present disclosure.

FIG. 10 is a schematic diagram illustrating an antenna apparatus applying a metal housing, according to an embodiment of the present disclosure.

Referring to FIG. 10, an antenna radiator 1000 is formed in a loop shape with a lower side opened. The antenna radiator 1000 has a slit 1002 provided in the center of the antenna radiator 1000, and is closed in the direction of a metal bezel 1030. The antenna radiator 1000 includes an interface connector port 1020 of metal material. The interface connector port 1020 may contribute as an antenna radiator as well.

The antenna radiator 1000 includes an opened portion and an opening end 1001 formed by the slit 1002. The opening end 1001 is formed to direct radiation in the direction of the interface connector port 1020. The opening end 1001 is formed to direct radiation in a reverse direction from the direction of the metal bezel 1030. Accordingly, the antenna radiator 1000 induces resonance at an opening end 1002 portion, and guides the radiation direction in a reverse direction from the direction of the metal bezel 1030 to exhibit efficient radiation performance.

The antenna radiator 1000 is configured such that a predetermined feeding line 1012 starting from a feeding part 1010 of an RF signal input/output port crosses the slit 1002 and electrically connects to the neighborhood of the opening end 1001. Accordingly, the antenna radiator 1000 may be an IFA. A matching element 1011 may be interposed in the feeding line 1012 to control an operation frequency band as well. A contact pad 1003 is formed in at least a partial region of the opening end 1001 and is electrically connected with the antenna radiator 1000. The contact pad 1003 may be connected with an additional antenna radiator. In this case, the additional antenna radiator is electrically connected with the antenna radiator 1000 by means of an electrical connection means (e.g., a C-clip, etc.) installed in the contact pad 1003.

The metal bezel 1030 is separated into corner bezel parts 1031 and 1033 and a lower bezel part 1032 by two segment parts 1034. The corner bezel part 1031 is ground connected with the antenna radiator 1000 by an electrical connection member 1035, and the lower bezel part 1032 is electrically connected with the antenna radiator 1000 by an electrical connection member 1036 as well, thereby contributing as additional antenna radiators.

Figure 11:
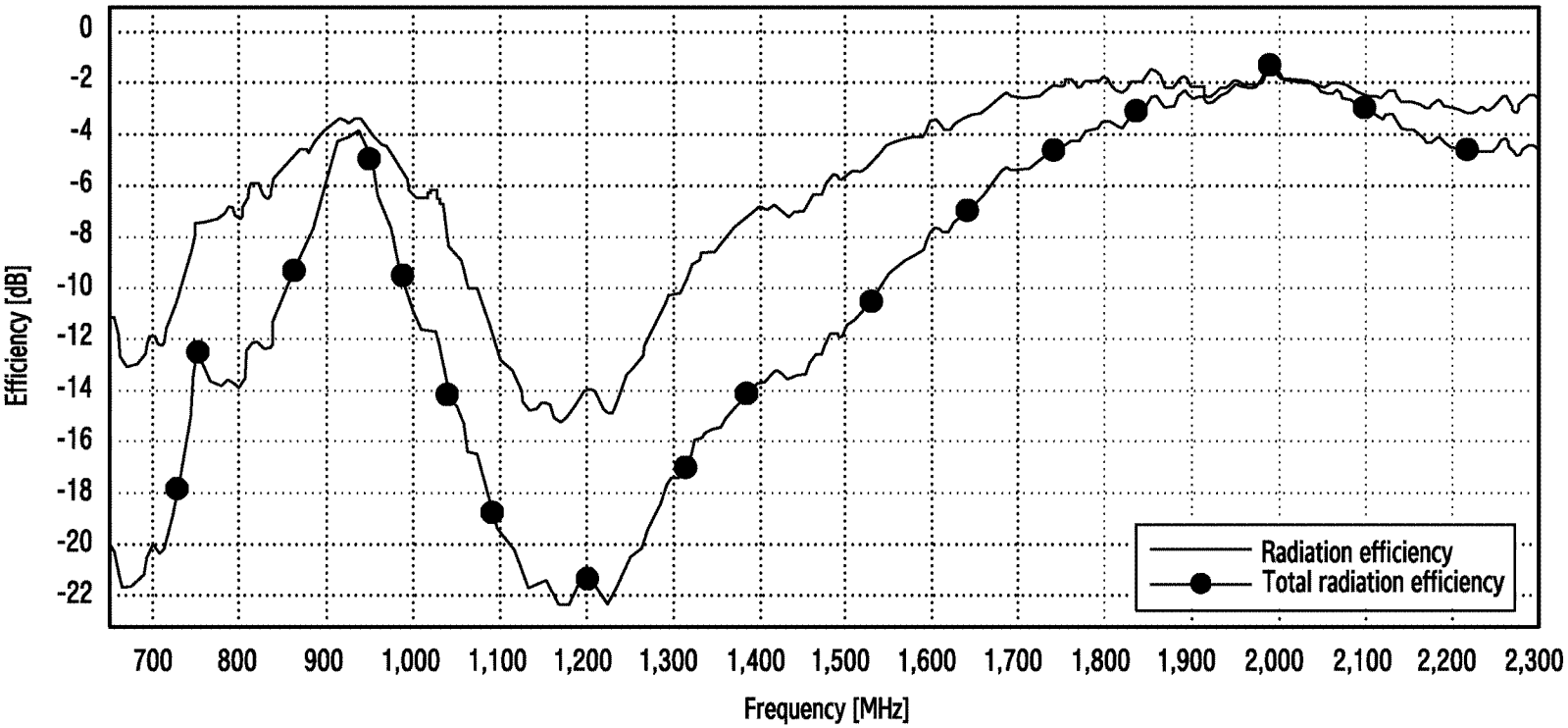
FIG. 11 is a graph showing efficiency related to a gain by frequency exhibited by an antenna apparatus, according to an embodiment of the present disclosure.

FIG. 11 is a graph showing efficiency related to a gain by frequency exhibited by an antenna apparatus, according to an embodiment of the present disclosure.

Referring to FIG. 11, a graph of the gain by frequency exhibited by the antenna apparatus is provided. As illustrated, an average gain in a low-frequency band is exhibited as 4.7 dB, and an average gain in a high-frequency band is exhibited as 3.5 dB. Accordingly, a performance improvement occurs at matching optimization.

Figure 12A:
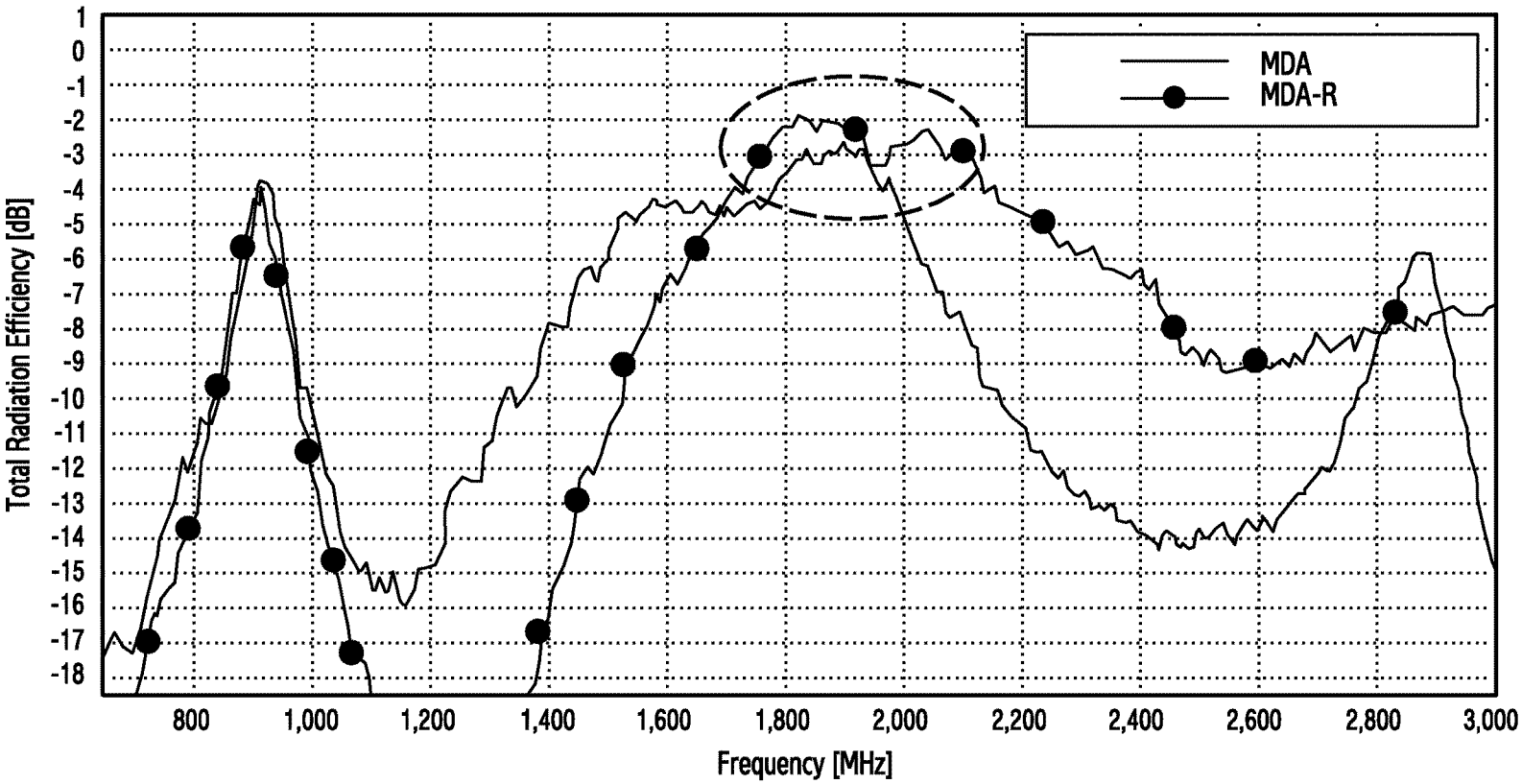
FIGS. 12A to 12C are graphs comparing efficiency by band caused by a free space of an antenna apparatus and a hand phantom, according to an embodiment of the present disclosure.
Figure 12B:
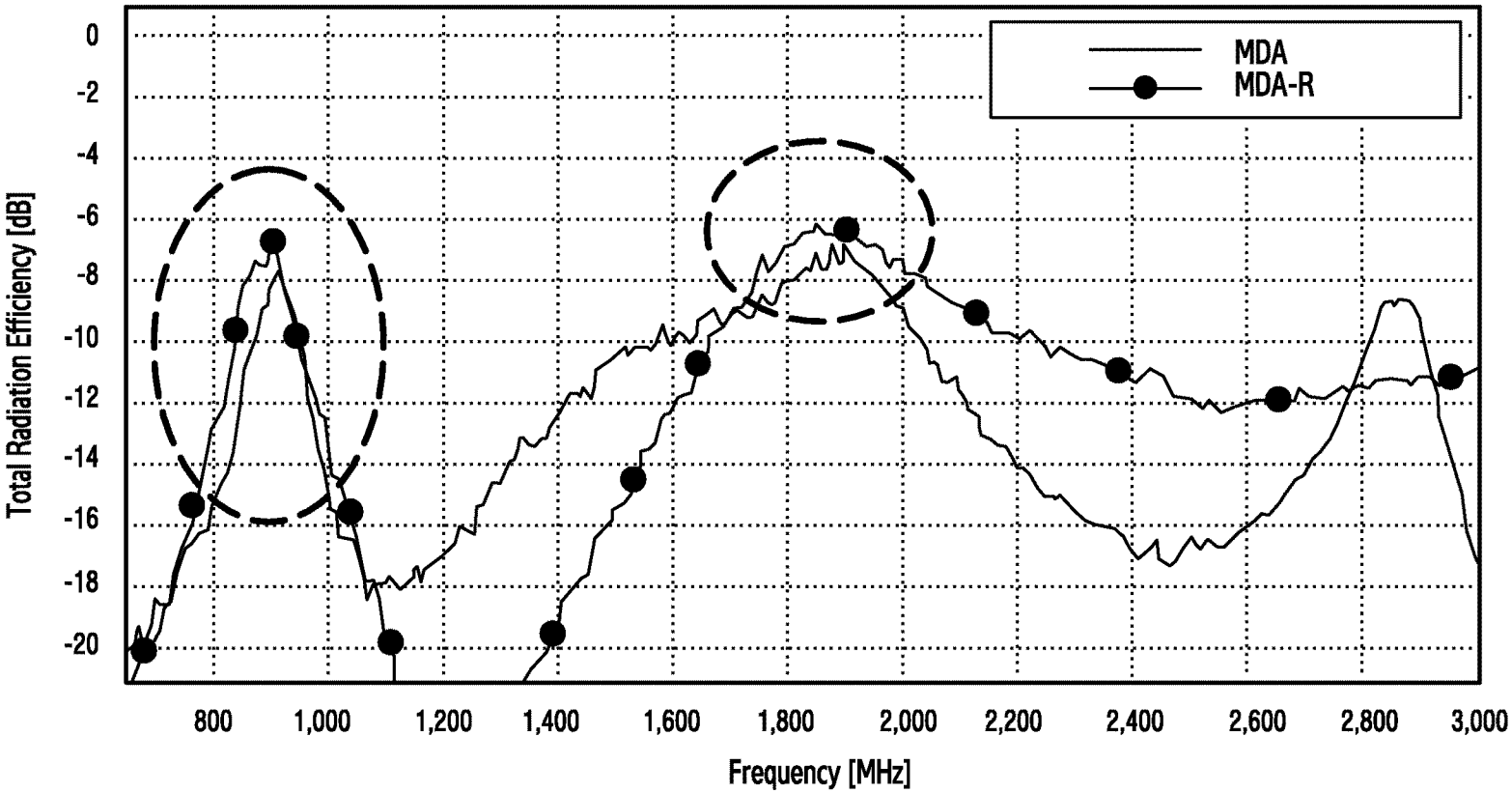
Figure 12C:
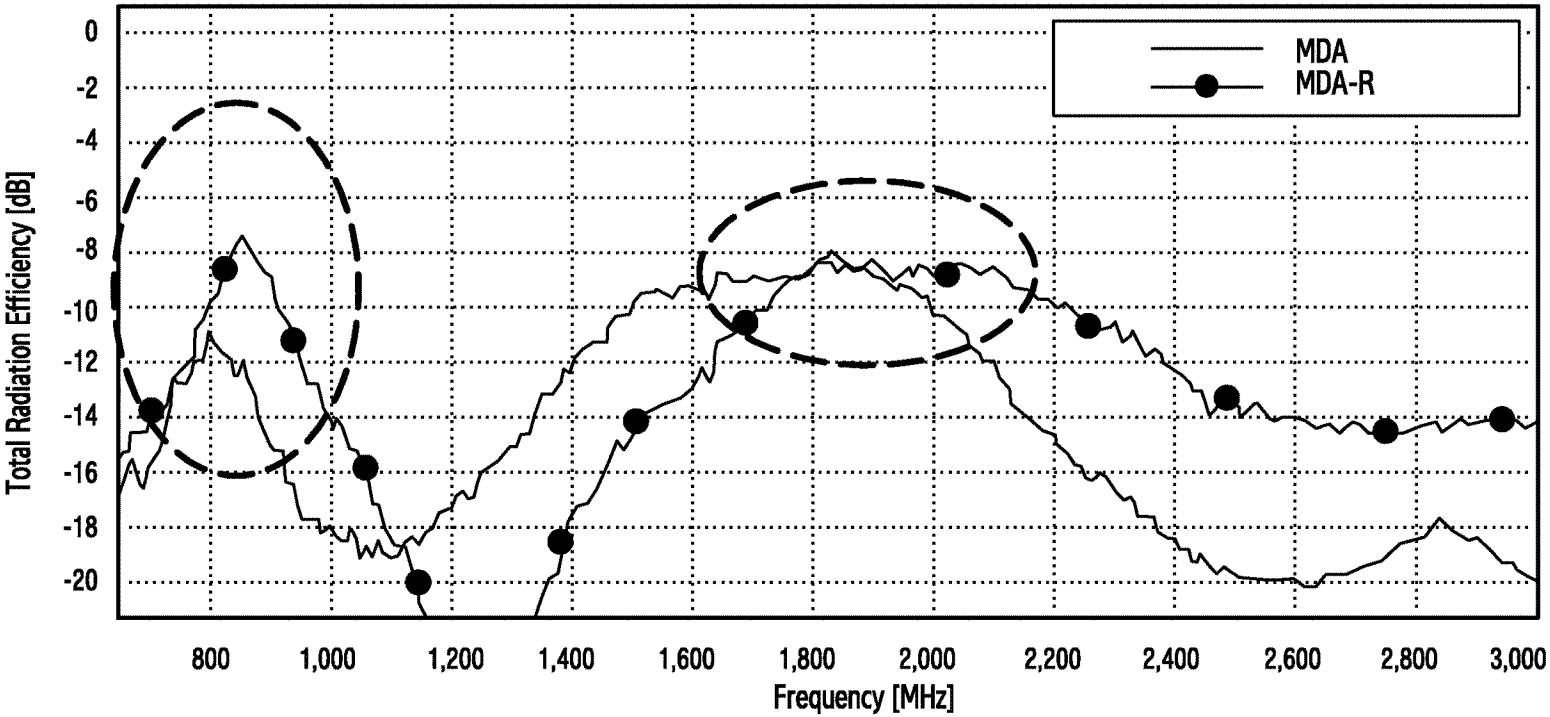

FIGS. 12A to 12C are graphs comparing efficiency by band caused by a free space of an antenna apparatus and a hand phantom, according to an embodiment of the present disclosure.

Referring to FIG. 12A, a graph comparing efficiency of an MDA and an MDA-R on a free space is provided. As illustrated, the efficiency of the MDA and the MDA-R are similar in a low-frequency band, and the MDA-R is predominant at approximately 1 dB in a main use band of a high-frequency band.

Referring to FIG. 12B, a graph comparing the efficiency of the MDA and the MDA-R when a right-hand phantom is applied to the electronic device 200 is provided. As illustrated, the MDA-R is predominant at approximately 1 dB in all bands.

Referring to FIG. 12C, a graph comparing the efficiency of the MDA and the MDA-R when a left-hand phantom is applied to the electronic device 200 is provided. As illustrated the MDA-R is predominant at approximately 4 dB in a low-frequency band, and the efficiency of the MDA and the MDA-R are similar in a high-frequency band.

According to various embodiments of the present disclosure, it may be appreciated from the aforementioned graphs that the MDA-R exhibits similar performance to the MDA or exhibits improved performance over the MDA in a specific band. As a result, the effect of radiation interference caused by a user's hand on an electronic device may be decreased.

Figure 13:
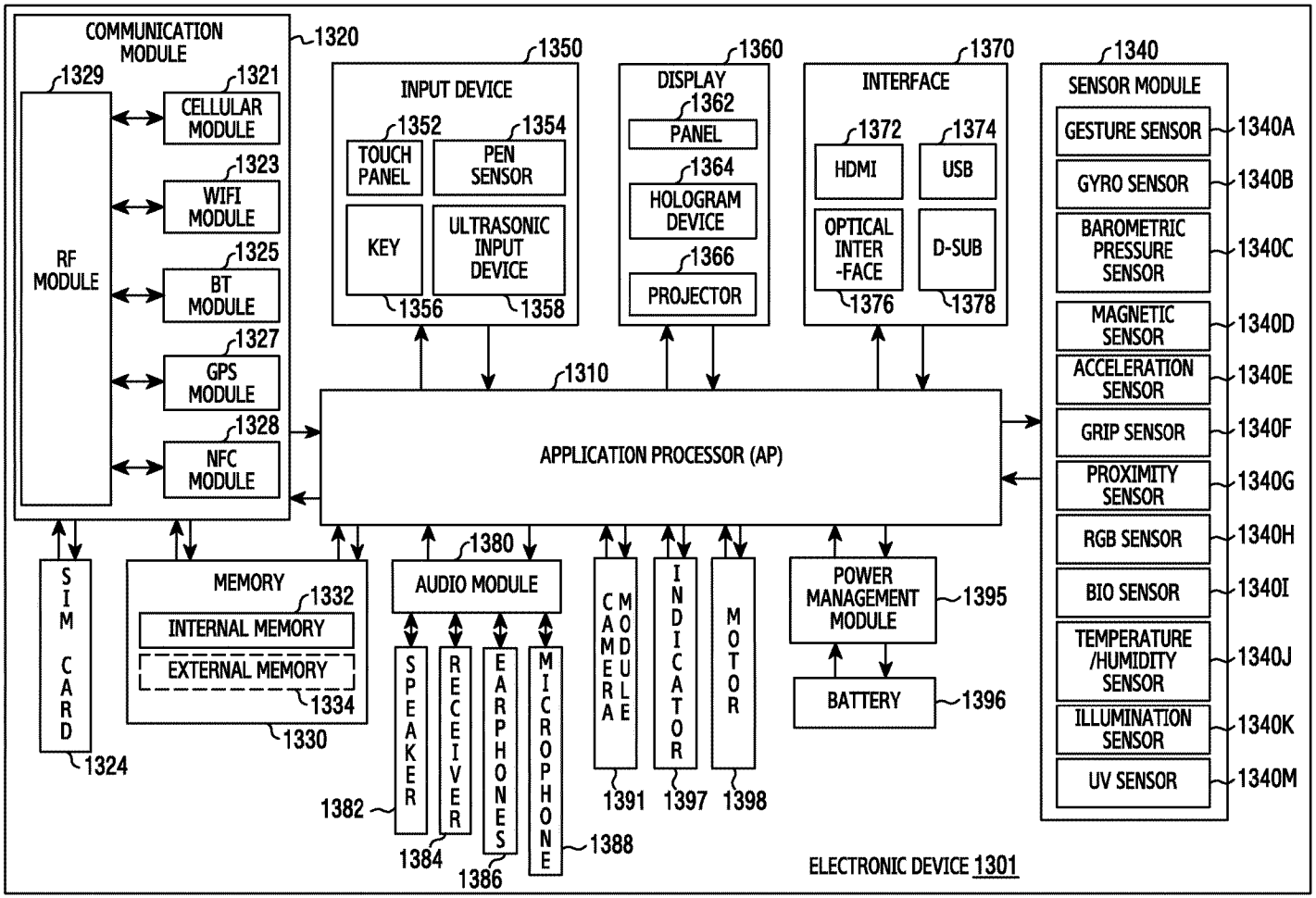
FIG. 13 is a block diagram of a configuration of an electronic device, according to an embodiment of the present disclosure.

FIG. 13 is a block diagram of a configuration of an electronic device, according to an embodiment of the present disclosure.

Referring to FIG. 13, a configuration of election device 1301 is provided. The electronic device 1301 may entirely or partially constitute the electronic device 101 of FIG. 1, the device 200 of FIGS. 2 and 3. Electronic device 1301 includes at least one Application Processor (AP) 1310, a communication module 1320, a Subscriber Identification Module (SIM) card 1324, a memory 1330, a sensor module 1340, an input device 1350, a display 1360, an interface 1370, an audio module 1380, a camera module 1391, a power management module 1395, a battery 1396, an indicator 1397, and a motor 1398.

The AP 1310 controls a plurality of hardware or software elements connected to the AP 1310 by driving an operating system or an application program. The AP 130 processes a variety of data, including multimedia data, and performs arithmetic operations. The AP 1310 may be implemented, for example, with a System on Chip (SoC). The AP 1310 may further include a Graphic Processing Unit (GPU).

The communication module 1320 (e.g., the communication interface 160) performs data transmission/reception in communication between other electronic devices (e.g., the electronic device 104 or the server 106) connected with the electronic device 1301 through a network. The communication module 1320 includes a cellular module 1321, a Wi-Fi module 1323, a BlueTooth (BT) module 1325, a Global Positioning System (GPS) module 1327, a Near Field Communication (NFC) module 1328, and a Radio Frequency (RF) module 1329.

The cellular module 1321 provides a voice call, a video call, a text service, an internet service, etc., through a communication network (e.g., Long Term Evolution (LTE), LTE-Advanced (LTE-A), Code Division Multiple Access (CDMA), Wideband CDMA (WCDMA), Universal Mobile Telecommunication System (UMTS), Wireless Broadband (WiBro), and Global System for Mobile communication (GSM), etc.). In addition, the cellular module 1321 identifies and authenticates the electronic device 1301 within the communication network by using a SIM card 1324. The cellular module 1321 may perform at least some of functions that can be provided by the AP 1310. For example, the cellular module 1321 may perform at least some of multimedia control functions.

The cellular module 1321 includes a Communication Processor (CP). Further, the cellular module 1321 may be implemented, for example, with an SoC. Although elements such as the cellular module 1321 (e.g., the CP), the memory 1330, and the power management module 1395 are illustrated as separate elements with respect to the AP 1310 in FIG. 13, the AP 1310 may also be implemented such that at least one part (e.g., the cellular module 1321) of the aforementioned elements is included in the AP 1310.

The AP 1310 or the cellular module 1321 (e.g., the CP) loads an instruction or data, which is received from each non-volatile memory connected thereto or at least one of different elements, to a volatile memory and processes the instruction or data. In addition, the AP 1310 or the cellular module 1321 stores data, which is received from at least one of different elements or generated by at least one of different elements, into the non-volatile memory.

Each of the WiFi module 1323, the BT module 1325, the GPS module 1327, and the NFC module 1328 includes a processor for processing data transmitted/received through a corresponding module. Although the cellular module 1321, the WiFi module 1323, the BT module 1325, the GPS module 1327, and the NFC module 1328 are illustrated in FIG. 13 as separate blocks, according to one embodiment, at least some (e.g., two or more) of the cellular module 1321, the WiFi module 1323, the BT module 1325, the GPS module 1327, and the NFC module 1328 may be included in one Integrated Chip (IC) or IC package. For example, at least some of processors corresponding to the cellular module 1321, the WiFi module 1323, the BT module 1325, the GPS module 1327, and the NFC module 1328 (e.g., a communication processor corresponding to the cellular module 1321 and a WiFi processor corresponding to the WiFi module 1323) may be implemented with an SoC.

The RF module 1329 transmits/receives data, for example an RF signal. The RF module 1329 may include, for example, a transceiver, a Power Amp Module (PAM), a frequency filter, a Low Noise Amplifier (LNA), etc. In addition, the RF module 1329 may further include a component for transmitting/receiving a radio wave on a free space in wireless communication, for example, a conductor, a conducting wire, etc. Although it is illustrated in FIG. 13 that the cellular module 1321, the WiFi module 1323, the BT module 1325, the GPS module 1327, and the NFC module 1328 share one RF module 1329, according to one embodiment, at least one of the cellular module 1321, the WiFi module 1323, the BT module 1325, the GPS module 1327, the NFC module 1328 may transmit/receive an RF signal via a separate RF module.

The SIM card 1324 is a card which is inserted into a slot formed at a specific location of the electronic device 1301. The SIM card 1324 includes unique identification information (e.g., an Integrated Circuit Card IDentifier (ICCID)) or subscriber information (e.g., an International Mobile Subscriber Identity (IMSI)).

The memory 1330 (e.g., the memory 130) includes an internal memory 1332 or an external memory 1334.

The internal memory 1332 may include, for example, at least one of a volatile memory (e.g., a Dynamic RAM (DRAM), a Static RAM (SRAM), a Synchronous Dynamic RAM (SDRAM), etc.) or a non-volatile memory (e.g., a One Time Programmable ROM (OTPROM), a Programmable ROM (PROM), an Erasable and Programmable ROM (EPROM), an Electrically Erasable and Programmable ROM (EEPROM), a Mask ROM, a Flash ROM, a NAND flash memory, a NOR flash memory, etc.). The internal memory 1332 may be a Solid State Drive (SSD).

The external memory 1334 may include a flash drive, and may further include, for example, Compact Flash (CF), Secure Digital (SD), Micro Secure Digital (Micro-SD), Mini Secure digital (Mini-SD), extreme Digital (xD), memory stick, and the like. The external memory 1334 may be operatively coupled to the electronic device 1301 via various interfaces.

The electronic device 1301 may further include a storage unit (or a storage medium) such as a hard drive.

The sensor module 1340 measures a physical quantity or detects an operation state of the electronic device 1301, and converts the measured or detected information into an electric signal. The sensor module 1340 includes, for example, at least one of a gesture sensor 1340A, a gyro sensor 1340B, a barometric pressure sensor 1340C, a magnetic sensor 1340D, an acceleration sensor 1340E, a grip sensor 1340F, a proximity sensor 1340G, a color sensor 1340H (e.g., a Red, Green, Blue (RGB) sensor), a bio sensor 1340I, a temperature/humidity sensor 1340J, an illumination sensor 1340K, and an Ultra Violet (UV) sensor 1340M. Additionally or alternatively, the sensor module 1340 may include, for example, an E-node sensor, an ElectroMyoGraphy (EMG) sensor, an ElectroEncephaloGram (EEG) sensor, an ElectroCardioGram (ECG) sensor, a fingerprint sensor, etc. The sensor module 1340 may further include a control circuit for controlling at least one or more sensors included therein.

The input device 1350 includes a touch panel 1352, a (digital) pen sensor 1354, a key 1356, or an ultrasonic input unit 1358.

The touch panel 1352 recognizes a touch input, for example, by using at least one of an electrostatic type, a pressure-sensitive type, and an ultrasonic type. The touch panel 1352 may further include a control circuit. In case of the electrostatic type of touch panel 1352, not only is physical contact recognition possible, but proximity recognition is also possible. The touch penal 1352 may further include a tactile layer. In this case, the touch panel 1352 provides the user with a tactile reaction.

The (digital) pen sensor 1354 may be implemented, for example, by using the same or similar method of receiving a touch input of the user or by using an additional sheet for recognition.

The key 1356 may be, for example, a physical button, an optical key, a keypad, or a touch key.

The ultrasonic input unit 1358 is a device by which the electronic device 1301 detects a sound wave through a microphone 1388 by using a pen which generates an ultrasonic signal, and is capable of radio recognition.

The electronic device 1301 may use the communication module 1320 to receive a user input from an external device (e.g., a computer or a server) connected thereto.

The display 1360 (e.g., the display 150) includes a panel 1362, a hologram 1364, or a projector 1366.

The panel 1362 may be, for example, a Liquid-Crystal Display (LCD), an Active-Matrix Organic Light-Emitting Diode (AM-OLED), etc. The panel 1362 may be implemented, for example, in a flexible, transparent, or wearable manner. The panel 1362 may be constructed as one module with the touch panel 1352.

The hologram 1364 uses an interference of light and displays a stereoscopic image in the air.

The projector 1366 displays an image by projecting a light beam onto a screen. The screen may be located inside or outside the electronic device 1301.

The display 1360 may further include a control circuit for controlling the panel 1362, the hologram 1364, or the projector 1366.

The interface 1370 includes, for example, a High-Definition Multimedia Interface (HDMI) 1372, a Universal Serial Bus (USB) 1374, an optical communication interface 1376, or a D-subminiature (D-sub) 1378. The interface 1370 may be included, for example, in the communication interface 160 of FIG. 1. Additionally or alternatively, the interface 1370 may include, for example, Mobile High-definition Link (MHL) (not shown), Secure Digital (SD)/Multi-Media Card (MMC) or Infrared Data Association (IrDA).

The audio module 1380 bilaterally converts a sound and electric signal. At least some elements of the audio module 13013 may be included in the input/output interface 140 of FIG. 1. The audio module 1380 converts sound information which is input or output through a speaker 1382, a receiver 1384, an earphone 1386, the microphone 1388, etc.

The camera module 1391 is a device for image and video capturing, and may include one or more image sensors (e.g., a front sensor or a rear sensor), a lens, an Image Signal Processor (ISP) (not shown), or a flash (not shown, e.g., LED or xenon lamp).

The power management module 1395 manages power of the electronic device 1301. The power management module

1395 may include a Power Management Integrated Circuit (PMIC), a charger Integrated Circuit (IC), or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, etc., may be added.

The battery gauge measures, for example, a residual quantity of the battery 1396 and a voltage, current, and temperature during charging. The battery 1396 stores or generates electricity and supplies power to the electronic device 1301 by using the stored or generated electricity. The battery 1396 may include a rechargeable battery or a solar battery.

The indicator 1397 indicates a specific state, for example, a booting state, a message state, a charging state, etc., of the electronic device 1301 or a part thereof (e.g., the AP 1310).

The motor 1398 converts an electric signal into a mechanical vibration.

The electronic device 1301 includes a processing unit (e.g., a GPU) for supporting mobile TV. The processing unit for supporting mobile TV processes media data according to a protocol of, for example, Digital Multimedia Broadcasting (DMB), Digital Video Broadcasting (DVB), media flow, etc.

Each of the aforementioned elements of the electronic device according to various embodiments of the present disclosure may consist of one or more components, and names thereof may vary depending on a type of electronic device. The electronic device according to various embodiments of the present disclosure may include at least one of the aforementioned elements. Some of the elements may be omitted, or additional other elements may be further included. In addition, some of the elements of the electronic device may be combined and constructed as one entity, so as to equally perform functions of corresponding elements before combination.

The term "module" used herein may imply a unit including one of hardware, software, and firmware, or a combination of them. The term "module" may be interchangeably used with terms such as unit, logic, logical block, component, circuit, etc. The "module" may be a minimum unit of an integrally constituted component or may be a part thereof. The "module" may be a minimum unit for performing one or more functions or may be a part thereof. The "module" may be mechanically or electrically implemented. For example, the "module" of the present disclosure includes at least one of an Application-Specific Integrated Circuit (ASIC) chip, a Field-Programmable Gate Arrays (FPGAs), and a programmable-logic device, which are known or will be developed and which perform certain operations.

According to various embodiments of the present disclosure, at least some parts of a device (e.g., modules or functions thereof) or method (e.g., operations) may be implemented with an instruction stored in a computer-readable storage media for example. The instruction may be executed by one or more processors (e.g., the processor 1310), to perform a function corresponding to the instruction. The computer-readable storage media may be, for example, the memory 1330. At least some parts of the programming module may be implemented (e.g., executed), for example, by the processor 1310. At least some parts of the programming module may include modules, programs, routines, sets of instructions, processes, and the like, for performing one or more functions.

The computer readable recording medium may be a hardware device configured particularly to store and perform a program instruction (e.g., program module), for example, a hard disk, a magnetic medium such as a floppy disc and a magnetic tape, an optical storage medium such as a Compact Disc-ROM (CD-ROM) or a Digital Versatile Disc (DVD), a magnetic-optic medium such as a floptical disc, a Read Only Memory (ROM), a Random Access Memory (RAM), a flash memory, etc. An example of the program instruction includes not only a machine language created by a compiler, but also a high-level programming language executable by a computer by using an interpreter or the like. The aforementioned hardware device may be configured to operate as one or more software modules to perform the operation of the present disclosure, and vice versa.

The module or programming module according to various embodiments of the present disclosure may further include at least one or more elements among the aforementioned elements, may omit some of them, or may further include additional elements. Operations performed by a module, programming module, or other elements may be executed in a sequential, parallel, repetitive, or heuristic manner. In addition, some of the operations may be executed in a different order or may be omitted, or other operations may be added.

While the present disclosure has been shown and described with reference to certain embodiments thereof, it will be understood by those skilled in the art that various changes in form and details may be made therein without departing from the spirit and scope of the present disclosure. Therefore, the scope of the present disclosure is defined not by the detailed description of the present disclosure, but by the appended claims and their equivalents, and all differences within the scope will be construed as being included in the present disclosure.

What is claimed is:

1. An electronic device comprising:

an antenna radiator formed in a loop shape having at least one opening end part opened by a slit, at least a portion of the at least one opening end part being fed;

at least one electronic component formed of metal material electrically connected with the antenna radiator; and at least one metal member arranged around the antenna radiator, wherein the at least one opening end part is formed in a reverse direction from the direction of the metal member.

2. The electronic device of claim 1, wherein the antenna radiator is an Inverted-F Antenna (IFA) of which an electrical length is controlled according to a feeding position of the at least one opening end part.

3. The electronic device of claim 1, wherein the antenna radiator is at least one of a metal plate and Flexible Printed Circuit (FPC) of a constant shape, which is formed in a Printed Circuit Board (PCB) in a pattern scheme or attached to the PCB.

4. The electronic device of claim 1, wherein the at least one metal member is ground connected with the antenna radiator.

5. The electronic device of claim 1, wherein the at least one metal member is electrically connected with the antenna radiator and used as an additional antenna radiator.

6. The electronic device of claim 1, wherein the antenna radiator comprises an additional antenna radiator electrically connected by a physical contact structure.

7. The electronic device of claim 6, wherein the additional antenna radiator is arranged on an antenna carrier of dielectric material.

8. The electronic device of claim 7, wherein the antenna radiator is formed in a Printed Circuit Board (PCB) and, when the antenna carrier is mounted on the PCB, the additional antenna radiator arranged on the antenna carrier is electrically connected with the antenna radiator.

9. The electronic device of claim 6, wherein a multi-band antenna apparatus is implemented by changing a length of the additional antenna radiator.

10. The electronic device of claim 1, further comprising:

a switching means interposed in a feeding line of the antenna radiator; and at least one additional antenna radiator electrically connected with the switching means, wherein a frequency band of the antenna radiator is switched by a switching operation of the switching means.

11. The electronic device of claim 1, wherein a ground is expanded by the at least one electronic component of the metal material, or a matching element is applied to control a resonance frequency of the antenna radiator.

12. The electronic device of claim 1, wherein the antenna radiator has at least one additional slit and operates as an independent additional antenna radiator.

13. The electronic device of claim 1, wherein the at least one electronic component of the metal material is at least one of a Universal Serial Bus (USB) connector port, a speaker, a microphone, an ear jack assembly, and a vibrator.

14. The electronic device of claim 1, wherein the at least one metal member is a metal housing arranged in at least a partial region of an external surface of the electronic device.

15. The electronic device of claim 1, wherein the at least one metal member is connected to a ground of a Printed Circuit Board (PCB) of the electronic device.

16. An antenna apparatus comprising:

an antenna radiator formed in a loop shape having at least one opening end part opened by a slit, at least a portion of the at least one opening end part is fed; and at least one electronic component of metal material electrically connected with the antenna radiator, wherein the at least one opening end part is formed in a reverse direction from the direction of a peripheral metal member.

17. The antenna apparatus claim 16, wherein the antenna radiator is an Inverted-F Antenna (IFA) of which an electrical length is controlled according to a feeding position of the at least one opening end part.

18. The antenna apparatus claim 16, wherein the metal member is ground connected with the antenna radiator.

19. The antenna apparatus claim 16, wherein the at least one metal member is electrically connected with the antenna radiator and used as an additional antenna radiator.

20. The antenna apparatus claim 16, wherein the antenna radiator is electrically connected with at least one additional antenna radiator by a physical contact structure.

* * * * *